US007752041B2

(12) United States Patent
Kim et al.

(10) Patent No.: US 7,752,041 B2
(45) Date of Patent: Jul. 6, 2010

(54) METHOD AND APPARATUS FOR ENCODING/DECODING DIGITAL SIGNAL

(75) Inventors: Dohyung Kim, Hwaseong-si (KR); Junghoe Kim, Seoul (KR); Shihwa Lee, Seoul (KR); Sangwook Kim, Seoul (KR); Yangseock Seo, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1226 days.

(21) Appl. No.: 11/137,427

(22) Filed: May 26, 2005

(65) Prior Publication Data

US 2005/0270195 A1 Dec. 8, 2005

(30) Foreign Application Priority Data

May 28, 2004 (KR) ..... 10-2004-0038212

(51) Int. Cl.
*G10L 19/00* (2006.01)

(52) U.S. Cl. ..... 704/229; 704/200.1; 704/500; 704/230; 341/106; 341/67

(58) Field of Classification Search ..... 704/229, 704/230, 200.1, 500–504; 341/106, 67
See application file for complete search history.

(56) References Cited

U.S. PATENT DOCUMENTS 5,864,802 A * 1/1999 Kim et al. ..... 704/230
6,061,649 A * 5/2000 Oikawa et al. ..... 704/226
6,094,636 A * 7/2000 Kim ..... 704/500
6,108,625 A * 8/2000 Kim ..... 704/229
6,195,633 B1 * 2/2001 Hu ..... 704/229
6,295,009 B1 * 9/2001 Goto ..... 341/50

(Continued)

FOREIGN PATENT DOCUMENTS

CN 1485849 3/2004
EP 1596366 A1 11/2005

OTHER PUBLICATIONS

Hiroto Saito et al., "Subadaptive Piecewise Linear Quantization for Speech Signal (64 kbit/s) Compression", IEEE Transactions on Speech and Audio Processing, vol. 4, No. 5, Sep. 1, 1996, pp. 379-382 (in English).

(Continued)

*Primary Examiner*—Vijay B Chawan
(74) *Attorney, Agent, or Firm*—Staas & Halsey LLP

(57) ABSTRACT

A method and an apparatus for encoding/decoding a digital signal are provided. First, a digital input signal is transformed into samples to remove redundant information among signals. Then, a lookup table corresponding to a characteristic of the input signal is selected among a plurality of lookup tables that indicate different numbers of bits allocated for each quantization unit depending on different characteristics of input signals, and the number of bits allocated for each quantization unit is acquired from the selected lookup table. Next, a distribution of samples within each quantization unit is divided into a predetermined number of sections, and the samples are linearly quantized using the allocated number of bits on a section-by-section basis. Thereafter, a bitstream comprised of frames is produced from the quantized samples and predetermined side information so that information about a frame length is stored in the end of frame.

73 Claims, 23 Drawing Sheets

U.S. PATENT DOCUMENTS

| | | | | |
|---|---|---|---|---|
| 6,792,402 | B1 * | 9/2004 | Chen | 704/200.1 |
| 6,882,976 | B1 * | 4/2005 | Hsu et al. | 704/500 |
| 7,292,163 | B1 * | 11/2007 | Fedele | 341/67 |
| 2005/0254588 | A1 * | 11/2005 | Kim et al. | 375/260 |
| 2005/0270195 | A1 * | 12/2005 | Kim et al. | 341/106 |

OTHER PUBLICATIONS

European Search Report for corresponding European Patent Application No. 08164671 dated Nov. 3, 2008 (6 pgs) (in English).

K. Brandenburg et al., "ISO-MPEG-1 Audio: A Generic Standard for Coding of High-Quality Digital Audio", XP-000978167, J. Audio Eng. Soc., vol. 42, No. 10, Oct. 1994, pp. 1-13 (in English).

European Search Report for corresponding European Patent Application No. 05253245 dated Apr. 28, 2008, 5 pgs (in English).

European Search Report for European App. No. 05253245.4 issued Sep. 22, 2005.

Chinese Office Action for corresponding Chinese Application 200510072245.6; mailed May 22, 2009.

* cited by examiner

FIG. 23

| ADDRESS | 0 | 1 | 2 | 3 | 4 | | 127 |
|---|---|---|---|---|---|---|---|
| SR | 1.0000000 | 0.8404964 | 0.7071068 | 0.5946036 | 0.5000000 | | 0.0000000 |

FIG. 24

| NUMBER OF BITS TO BE ALLOCATED / ADDRESS | 0 | 1 | ・・・ | 7 | 8 | ・・・ | 14 | 15 |
|---|---|---|---|---|---|---|---|---|
| ⋮ | | | | | | | | |
| 5 | 2 | 3 | ・・・ | 1300 | 6543 | ・・・ | 189 | 89 |
| ⋮ | | | | | | | | |
| 30 | 5 | 3 | ・・・ | 5656 | 787 | ・・・ | 547 | 54 |
| 31 | | | | | | | | |
| ⋮ | | | | | | | | |
| 61 | 7890 | 2356 | ・・・ | 56 | 3 | ・・・ | 0 | 0 |

METHOD AND APPARATUS FOR ENCODING/DECODING DIGITAL SIGNAL

CROSS-REFERENCE TO RELATED APPLICATIONS

This application claims the benefit of Korean Patent Application No. 10-2004-0038212, filed on May 28, 2004, in the Korean Intellectual Property Office, the disclosure of which is incorporated herein in its entirety by reference.

BACKGROUND OF THE INVENTION

1. Field of the Invention

Embodiments of the present invention relate to encoding and decoding of a digital signal, and more particularly, to a method and apparatus for encoding/decoding a digital signal, in which a digital signal is encoded into a bit stream including information about a length of a frame by using a plurality of lookup tables and linear quantization by sections, and the bit stream is decoded into the original digital signal.

2. Description of the Related Art

FIG. 1 is a block diagram of a general digital signal encoding apparatus using an psycho-acoustic model in the MPEG-1. The general digital signal encoding apparatus is comprised of a frequency mapping portion 100, psycho-acoustic model 110, a bit allocation portion 120, a quantization portion 130, and a bitstream producing portion 140.

The frequency mapping portion 100 transforms a time-domain input signal into a predetermined number of frequency bands using a band analysis filter. The psycho-acoustic model 110 is a portion of the encoding apparatus that performs the most complicate calculation. That is, the psycho-acoustic model 110 calculates a signal-to-mask ratio (SMR), which is a basis of bit allocation for each frequency band. The SMR is calculated by the following operations. First, a time-domain audio signal is transformed into a frequency-domain audio signal using fast Fourier transform (FFT), and a sound pressure level and an absolute threshold of each frequency band are calculated. Thereafter, voice and voiceless sound components of the audio signal and a masker of the audio signal are determined, and a masking threshold of each frequency band and an overall masking threshold are calculated. Finally, a minimal masking threshold of each frequency band is calculated, thereby calculating the SMR of each frequency band.

The bit allocation portion 120 calculates the number of bits to be allocated for each frequency band by repeating the following operations based on the SMR received from the psycho-acoustic model 110. First, an initial allocated bit is set as 0, and a mask-to-noise ratio (MNR) for each frequency band is obtained. Here, the MNR is obtained by subtracting the SMR from a signal-to-noise ratio (SNR). Thereafter, a frequency band having the minimal MNR among MNRs for the frequency bands is searched for, and the number of bits allocated for the found frequency band increases 1. If the number of bits allocated for the entire input signal does not exceed a required number of allocated bits, frequency bands other than the found frequency band undergo the above-described operations.

The quantization portion 130 quantizes the input signal using a scale vector and allocated bits. The bitstream producing portion 140 produces a bit stream using the quantized input signal.

As described above, a conventional digital signal encoding method using psycho-acoustic model obtains an SMR through a complicate process. Thus, a calculation performed in the conventional digital signal encoding method becomes complicated, leading to an increase in the time required to execute the digital signal encoding method. Since an MNR is calculated using the SMR obtained through the complicate process, and a bit allocation loop is repeated based on the MNR, time delay also occurs during the repetition of the bit allocation loop.

FIG. 2 is a block diagram of a conventional digital signal encoding apparatus using a single lookup table. The encoding apparatus is comprised of a frequency mapping portion 200, a lookup table 210, a number-of-allocated-bits extraction portion 220, a quantization portion 230, and a bitstream producing portion 240.

The frequency mapping portion 200 transforms a time-domain input signal into a predetermined number of frequency bands using a band analysis filter. The lookup table 210 stores numbers of bits allocated to encode the frequency bands, in addresses corresponding to characteristics of the frequency bands.

The number-of-allocated-bits extraction portion 220 calculates an address value for each of the frequency bands of the input signal and extracts the numbers of allocated bits stored in the addresses for the frequency bands from the lookup table 210. The quantization portion 230 quantizes the input signal using the numbers of bits allocated for the frequency bands. The bitstream producing portion 240 produces a bitstream using the quantized input signal.

In a conventional method of encoding a digital signal using a single lookup table, to obtain a number of bits allocated for a unit in which the digital signal is quantized (hereafter, referred to as a quantization unit) as described above, the numbers of bits allocated per frequency band are extracted from the lookup table and used in encoding the digital signal. Hence, the complicated calculation and the time delay due to the use of a psycho-acoustic model can be prevented. However, since various input signals having different characteristics must be encoded using the single lookup table, there exists a limit in adaptively encoding the input signals according to their characteristics.

In the MPEG-1/2 audio encoding technology, sub-band samples obtained by sub-band filtering are linearly quantized using information about bit allocation presented by psychoacoustics and undergo a bit packing process, thereby completing audio encoding. A linear quantizer, which performs the linear quantization, provides optimal performance when data has a uniform distribution. However, a data distribution is actually approximate to a Guassian or Laplacian distribution. Hence, the quantizer is preferably designed to fit each distribution, and can show an optimal result in respect of a mean squared error (MSE). A general audio encoder, such as, an MPEG-2/4 Advanced Audio Coding (AAC) encoder, uses a $x^{4/3}$ nonlinear quantizer, which is designed in consideration of a sample distribution of a modified discrete cosine transform (MDCT) and the psycho-acoustic perspective. However, the encoder is highly complex due to the characteristics of a nonlinear quantizer. Therefore, the nonlinear quantizer cannot be used as an audio encoder that requires low complexity.

When audio encoding proposed by MPEG-1 and MPEG-2 is performed using a fixed bitrate, sync information is located at a beginning portion of each frame. When audio encoding proposed by MPEG-4 is not performed at a fixed bitrate, information about a frame length is located at a beginning portion of each frame.

When an impact is applied to an audio reproducing apparatus, only effective data, which is not affected by the impact, except for an impacted portion of a buffer in the audio reproducing apparatus should be reproduced. When an encoding rate used is a fixed bit rate, a length of each frame, that is, a size of an area of the buffer occupied by each frame, is consistent. Accordingly, an area of the buffer occupied by a frame previous to a damaged frame can be easily searched for. On the other hand, when the encoding rate used is a variable bit rate, a length of each frame, that is, a size of an area of the buffer occupied by each frame, is inconsistent. Accordingly, it is impossible to search for an area of the buffer occupied by a frame previous to a damaged frame by only using frame length information recorded at a beginning portion of each frame.

SUMMARY OF THE INVENTION

An embodiment of the present invention provides a method and an apparatus for encoding a digital signal, by which the digital signal is adaptively encoded using a plurality of lookup tables produced based on characteristics of the digital signal, and the complexity of a nonlinear quantizer is significantly reduced while providing a sound of better quality than a general linear quantizer in consideration of a distribution of digital data.

An embodiment of the present invention also provides a method and an apparatus for encoding a digital signal, by which the digital signal is adaptively encoded using a plurality of lookup tables produced based on characteristics of the digital signal to produce a bitstream including frame length information useful upon digital signal encoding at a variable bitrate.

An embodiment of the present invention also provides a method and an apparatus for encoding a digital signal, by which the complexity of a nonlinear quantizer is significantly reduced while providing a sound of better quality than a general linear quantizer in consideration of a distribution of digital data, and the digital signal is encoded into a bitstream including frame length information useful upon digital signal encoding at a variable bitrate.

An embodiment of the present invention also provides a method and an apparatus for encoding a digital signal, by which the digital signal is adaptively encoded using a plurality of lookup tables produced based on characteristics of the digital signal, the complexity of a nonlinear quantizer is significantly reduced while providing a sound of better quality than a general linear quantizer in consideration of a distribution of digital data, and the digital signal is encoded into a bitstream including frame length information useful upon digital signal encoding at a variable bitrate.

An embodiment of the present invention also provides a method and an apparatus for decoding a bitstream into which a digital signal is adaptively encoded using a plurality of lookup tables produced based on characteristics of the digital signal so that the complexity of a nonlinear quantizer can be significantly reduced while providing a sound of better quality than a general linear quantizer in consideration of a distribution of digital data.

An embodiment of the present invention also provides a method and an apparatus for decoding a bitstream including frame length information, into which a digital signal is adaptively encoded using a plurality of lookup tables produced based on characteristics of the digital signal.

An embodiment of the present invention also provides a method and an apparatus for decoding a bitstream including frame length information into which a digital signal is encoded so that the complexity of a nonlinear quantizer is significantly reduced while providing a sound of better quality than a general linear quantizer in consideration of a distribution of digital data.

An embodiment of the present invention also provides a method and an apparatus for decoding a bitstream including frame length information into which a digital signal is adaptively encoded using a plurality of lookup tables produced based on characteristics of the digital signal so that the complexity of a nonlinear quantizer is significantly reduced while providing a sound of better quality than a general linear quantizer in consideration of a distribution of digital data.

According to an aspect of the present invention, there is provided a method of encoding a digital signal. The method comprises transforming a digital input signal into samples to remove redundant information among signals, selecting a lookup table corresponding to a characteristic of the digital input signal among a plurality of lookup tables that indicate different numbers of bits allocated for each of a plurality of quantization units depending on different characteristics of input signals and acquiring the number of bits allocated for each quantization unit from the selected lookup table, dividing a distribution of samples within each quantization unit into a predetermined number of sections and linearly quantizing the samples using the allocated number of bits on a section-by-section basis, and producing a bitstream from the linearly quantized samples and predetermined side information.

According to another aspect of the present invention, there is provided a method of encoding a digital signal. The method comprises transforming a digital input signal into samples to remove redundant information among signals, selecting a lookup table corresponding to a characteristic of the digital input signal among a plurality of lookup tables that indicate different numbers of bits allocated for each of a plurality of quantization units depending on different characteristics of input signals and acquiring the number of bits allocated for each quantization unit from the selected lookup table, quantizing the samples using the number of bits allocated for each quantization unit, and producing a bitstream comprised of frames from the quantized samples and predetermined side information so that information about a frame length is stored in the end of the frame.

According to an aspect of the present invention, there is provided a method of encoding a digital signal. The method comprises transforming a digital input signal into samples to remove redundant information among signals, calculating a number of bits to be allocated for each of a plurality of quantization units, dividing a distribution of samples within each quantization unit into a predetermined number of sections and linearly quantizing the samples using the allocated bits on a section-by-section basis, and producing a bitstream comprised of frames from the quantized samples and predetermined side information so that information about a frame length is stored in the end of the frame.

According to an aspect of the present invention, there is provided a method of encoding a digital signal. The method comprises transforming a digital input signal into samples to remove redundant information among signals, selecting a lookup table corresponding to a characteristic of the input signal among a plurality of lookup tables that indicate different numbers of bits allocated for each of a plurality of quantization units depending on different characteristics of input signals and acquiring the number of bits allocated for each quantization unit from the selected lookup table; dividing a distribution of samples within each quantization unit into a predetermined number of sections and linearly quantizing the samples using the allocated number of bits on a section-by-section basis; and producing a bitstream comprised of frames from the quantized samples and predetermined side information so that information about a frame length is stored in the end of the frame.

The transformation of the digital signal may be performed using one of a modified discrete cosine transform, a fast Fourier transform, a discrete cosine transform, and a sub-band filtering. The side information may include at least a scale factor of each quantization unit and a number of bits to be allocated for each quantization unit.

The characteristic of the input signal in the operation of selecting the lookup table and acquiring the number of bits allocated may be the number of frequency bands including samples at occupancy rates no less than or no greater than a predetermined reference value among frequency bands of the input signal. The occupancy rate may comprise either or both of a larger occupancy rate between an occupancy rate of a squared scale factor of a frequency band and an occupancy rate of a mean power of samples within the frequency band or a larger occupancy rate between an occupancy rate of a scale factor of a frequency band and an occupancy rate of a mean value of samples within the frequency band.

Each of the lookup tables may include at least one address for each quantization unit and a predetermined number of bits for each quantization unit. The addresses of each of the lookup tables may comprise scale factors or squared scale factors of the frequency bands, mean values or mean powers of samples within the frequency bands, larger occupancy rates between occupancy rates of scale factors of the frequency bands and occupancy rates of mean values of samples within the frequency bands, or larger occupancy rates between occupancy rates of squared scale factors of the frequency bands and occupancy rates of mean powers of samples within the frequency bands.

The operation of dividing the distribution of the samples and linearly quantizing the samples may include: normalizing the samples within each quantization unit using a predetermined scale factor; dividing a range of normalized sample values into a predetermined number of sections and transforming the normalized sample values by applying a linear function set for each section; scaling the transformed values using the number of bits allocated for each quantization unit; and rounding the scaled values to the nearest whole number to obtain quantized values.

The scale factor may be an integer determined by a predetermined function of a value no less than a maximum absolute value among sample values within each quantizing unit.

The linear functions may be a plurality of independent linear functions for the sections. The operation of dividing the range of the normalized sample values and transforming the normalized sample values may comprise: dividing the range of the normalized sample values into two sections; and transforming the normalized data by applying linear functions set for the two sections to the normalized data. The linear functions are expressed as $$y = \frac{ax}{(a-2b)}$$

and $$y = \frac{x}{(1+2b)} + \frac{2b}{(1+2b)},$$

wherein a denotes the range of normalized values, and b denotes section displacement from the center of a. The linear quantization by sections may satisfy continuity.

The bitstream comprised of frames may further include sync information indicating a beginning of each frame, which is located in a head portion of each frame. The bitstream comprised of frames may be a result of encoding at a fixed bit rate or a variable bit rate.

According to another aspect of the present invention, there is provided an apparatus for encoding a digital signal. The apparatus comprises a data transformation portion transforming a digital input signal into samples to remove redundant information among signals, a plurality of lookup tables indicating different numbers of bits allocated for each of a plurality of quantization units depending on different characteristics of input signals, a lookup table selection portion selecting a lookup table corresponding to a characteristic of the digital input signal among the lookup tables, a bit allocation portion extracting the numbers of bits allocated for the quantization units from addresses for the quantization units in the selected lookup table, a linear quantization portion dividing a distribution of samples within each quantization unit into a predetermined number of sections and linearly quantizing the samples using the allocated number of bits on a section-by-section basis, and a bit packing portion producing a bitstream from the linearly quantized samples and predetermined side information.

According to another aspect of the present invention, there is provided an apparatus for encoding a digital signal. The apparatus comprises a data transformation portion transforming a digital input signal into samples to remove redundant information among signals, a plurality of lookup tables indicating different numbers of bits allocated for each of a plurality of quantization units depending on different characteristics of input signals, a lookup table selection portion selecting a lookup table corresponding to a characteristic of the input signal among the lookup tables, a bit allocation portion extracting the numbers of bits allocated for the quantization units from addresses for the quantization units in the selected lookup table, a quantization portion quantizing the samples using the number of bits allocated for each quantization unit by the bit allocation portion, and a bitstream producing portion producing a bitstream comprised of frames from the linearly quantized samples and predetermined side information so that information about a frame length is included in the end of the frame.

According to another aspect of the present invention, there is provided an apparatus for encoding a digital signal. The apparatus comprises a data transformation portion transforming a digital input signal into samples to remove redundant information among signals, a number-of-bits-to-be-allocated calculating portion calculating the number of bits to be allocated for each of a plurality of quantization units, a linear quantization portion dividing a distribution of samples within each quantization unit into a predetermined number of sections and linearly quantizing the samples using the allocated number of bits on a section-by-section basis, and a bitstream producing portion producing a bitstream comprised of frames from the linearly quantized samples and predetermined side information so that information about a frame length is included in the end of the frame.

According to another aspect of the present invention, there is provided an apparatus for encoding a digital signal. The apparatus comprises a data transformation portion transforming a digital input signal into samples to remove redundant information among signals, a plurality of lookup tables indicating different numbers of bits allocated for each of a plurality of quantization units depending on different characteristics of input signals, a lookup table selection portion selecting a lookup table corresponding to a characteristic of the digital input signal among the lookup tables, a bit allocation portion extracting the numbers of bits allocated for the quantization units from addresses for the quantization units in the selected lookup table, a linear quantization portion dividing a distribution of samples within each quantization unit into a predetermined number of sections and linearly quantizing the samples using the allocated number of bits on a section-by-section basis, and a bitstream producing portion producing a bitstream comprised of frames from the linearly quantized samples and predetermined side information so that information about a frame length is included in the end of the frame.

The characteristic of the input signal in the selecting of the lookup table and acquiring of the number of bits allocated may comprise the number of frequency bands including samples at occupancy rates no less than or no greater than a predetermined reference value among frequency bands of the input signal. The occupancy rate may comprise either or both of a larger occupancy rate between an occupancy rate of a squared scale factor of a frequency band and an occupancy rate of a mean power of samples within the frequency band or a larger occupancy rate between an occupancy rate of a scale factor of a frequency band and an occupancy rate of a mean value of samples within the frequency band.

The linear quantization portion may comprise a data normalization portion normalizing the samples obtained by the data transformation portion using a predetermined scale factor, a section quantization portion dividing a range of normalized sample values into a predetermined number of sections and applying a linear function set for each section to the normalized sample values, a scaling portion scaling the values obtained by the section quantization portion using the number of bits allocated for each quantization unit by the bit allocation portion, and a rounding portion rounding the scaled values to the nearest whole number using the number of allocated bits to obtain quantized values.

The bitstream comprised of frames may further include sync information indicating a beginning of each frame, which is located in a head portion of each frame.

According to another aspect of the present invention, there is provided a method of decoding a digital signal. The method comprises extracting data that is linearly quantized by sections and side information from a bitstream, dequantizing the linearly quantized data by sections corresponding to the sections divided for the linear quantization, using the side information, and producing a digital signal from the dequantized data using an inverse transformation of a transformation used for encoding.

According to another aspect of the present invention, there is provided a method of decoding a digital signal. The method comprises extracting quantized data, side information, and frame length information from a bitstream comprised of frames, dequantizing the quantized data using the side information, and producing a digital signal from the dequantized data using an inverse transformation of a transformation used for encoding.

According to another aspect of the present invention, there is provided a method of decoding a digital signal. The method comprises extracting data that is linearly quantized by sections, side information, and frame length information from a bitstream comprised of frames, dequantizing the linearly quantized data by sections corresponding to sections divided for quantization, using the side information; and producing a digital signal from the dequantized data using an inverse transformation of a transformation used for encoding.

The side information may include at least a scale factor of each quantization unit and a number of bits to be allocated for each quantization unit. In the operation of extracting the linearly quantized data, the side information, and the frame length information, sync information may be further extracted from the bitstream comprised of frames.

The operation of dequantizing the linearly quantized data by sections may comprise performing an inverse scaling of a scaling used for quantization on the data which is linearly quantized by sections, by using bit allocation information, linearly dequantizing the inversely scaled data by the sections, and denormalizing the dequantized data using an inverse scale factor corresponding to a scale factor used for quantization. The inverse transformation of the dequantized digital signal may be performed using an inverse modified discrete cosine transform, an inverse fast Fourier transform, an inverse discrete cosine transform, or a sub-band synthesis filtering.

According to another aspect of the present invention, there is provided an apparatus for decoding a digital signal. The apparatus comprises a bit unpacking portion extracting linearly quantized data and side information from a bitstream, a linear dequantization portion dequantizing the linearly quantized data by sections corresponding to sections divided for the linear quantization, using the side information; and an inverse transformation portion producing a digital signal from the dequantized data using an inverse transformation of a transformation used for encoding.

According to another aspect of the present invention, there is provided an apparatus for decoding a digital signal. The apparatus comprise a bitstream analyzing portion extracting quantized data, side information, and frame length information from a bitstream comprised of frames, a dequantization portion dequantizing the quantized data using the side information, and an inverse transformation portion producing a digital signal from the dequantized data using an inverse transformation of a transformation used for encoding.

According to another aspect of the present invention, there is provided an apparatus for decoding a digital signal. The apparatus comprises a bitstream analyzing portion extracting data that is linearly quantized by sections, side information, and frame length information from a bitstream comprised of frames; a linear dequantization portion dequantizing the linearly quantized data by sections corresponding to sections divided for quantization, using the side information; and an inverse transformation portion producing a digital signal from the dequantized data using an inverse transformation of a transformation used for encoding. The side information may include at least a scale factor of each quantization unit and a number of bits to be allocated for each quantization unit.

The bitstream analyzing portion may further extract sync information from the bitstream comprised of frames.

The linear dequantization portion may comprise an inverse scaling portion performing an inverse scaling of a scaling used for quantization on the data which is linearly quantized by sections, by using bit allocation information included in the side information of the bitstream analyzing portion, a section linear dequantization portion linearly dequantizing the inversely scaled data by the sections, and a denormalizing portion denormalizing the dequantized data using an inverse scale factor corresponding to a scale factor used for quantization.

According to another aspect of the present invention, there is provided a storage for controlling a computer according to a method of encoding a digital signal. The method comprises transforming a digital input signal into samples to remove redundant information among signals, selecting a lookup table corresponding to a characteristic of the digital input signal among a plurality of lookup tables that indicate different numbers of bits allocated for each of a plurality of quantization units depending on different characteristics of input signals and acquiring the number of bits allocated for each quantization unit from the selected lookup table, dividing a distribution of samples within each quantization unit into a predetermined number of sections and linearly quantizing the samples using the allocated number of bits on a section-by-section basis, and producing a bitstream from the linearly quantized samples and predetermined side information. The characteristic of the input signal in the selecting of the lookup table and acquiring of the number of bits allocated comprises the number of frequency bands including samples at occupancy rates no less than or no greater than a predetermined reference value among frequency bands of the digital input signal.

According to another aspect of the present invention, there is provided a storage for controlling a program according to a method of decoding a digital signal. The method comprises extracting data that is linearly quantized by sections, side information, and frame length information from a bitstream comprised of frames, dequantizing the linearly quantized data by sections corresponding to sections divided for quantization, using the side information, and producing a digital signal from the dequantized data using an inverse transformation of a transformation used for encoding.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 23 is a table illustrating a method of setting addresses used in a lookup table, according to an embodiment of the present invention;

FIG. 24 is a table illustrating a method of producing a lookup table, according to an embodiment of the present invention;

DETAILED DESCRIPTION OF THE PREFERRED EMBODIMENTS

Figure 1:
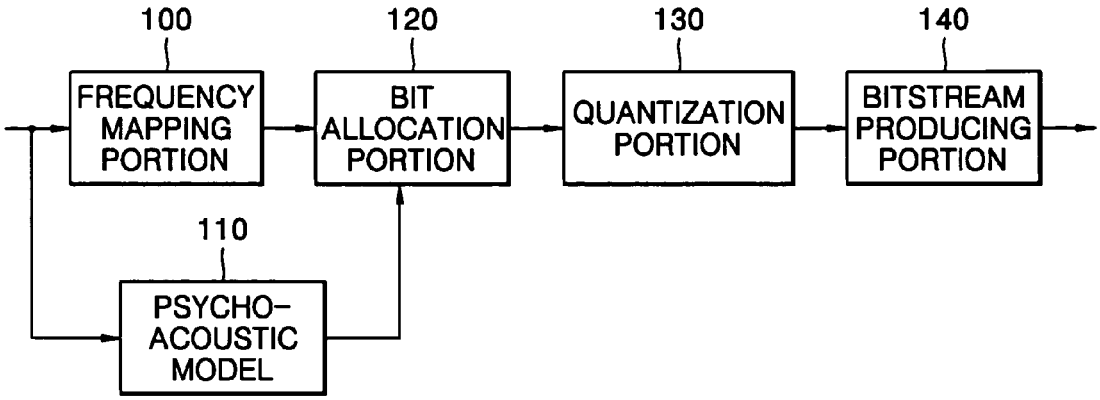
FIG. 1 (PRIOR ART)
FIG. 1 is a block diagram of a conventional digital signal encoding apparatus using a psycho-acoustic model in the MPEG-1.
Figure 2:
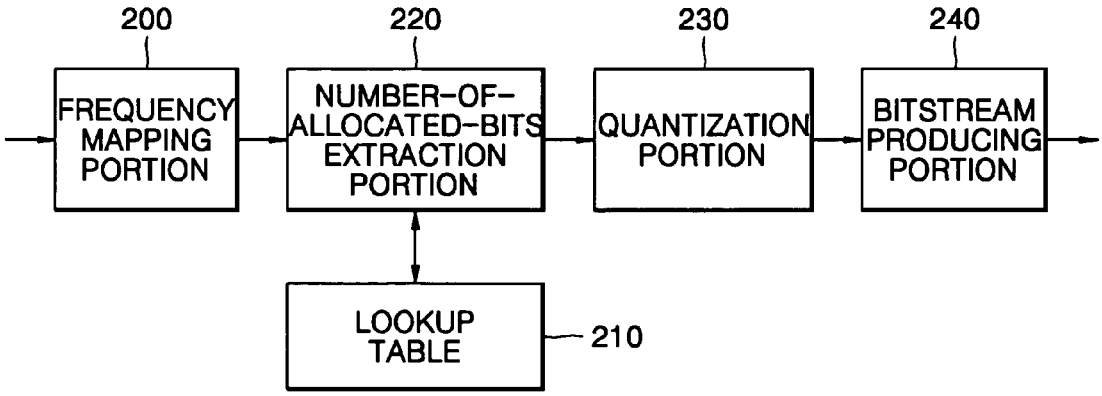
FIG. 2 (PRIOR ART)
FIG. 2 is a block diagram of a conventional digital signal encoding apparatus using a single lookup table.

Reference will now be made in detail to the embodiments of the present invention, examples of which are illustrated in the accompanying drawings, wherein like reference numerals refer to the like elements throughout. The embodiments are described below to explain the present invention by referring to the figures.

A digital signal encoding/decoding method and apparatus according to an embodiment of the present invention will now be described in detail with reference to the accompanying drawings, in which embodiments of the invention are shown.

A digital signal encoding apparatus according to an embodiment of the present invention is obtained by improving a bit allocation portion, a quantization portion, and a bit packing portion of a general digital signal encoding apparatus, which further includes a data transformation portion. To be more specific, the improved bit allocation portion calculates a number of bits allocated for a unit in which a digital input signal is quantized (hereinafter, referred as a quantization unit), using a plurality of lookup tables produced based on characteristics of an input signal. The improved quantization portion performs linear quantization by sections. The bit packing portion produces a bitstream including information about a length of a frame.

Figure 3:
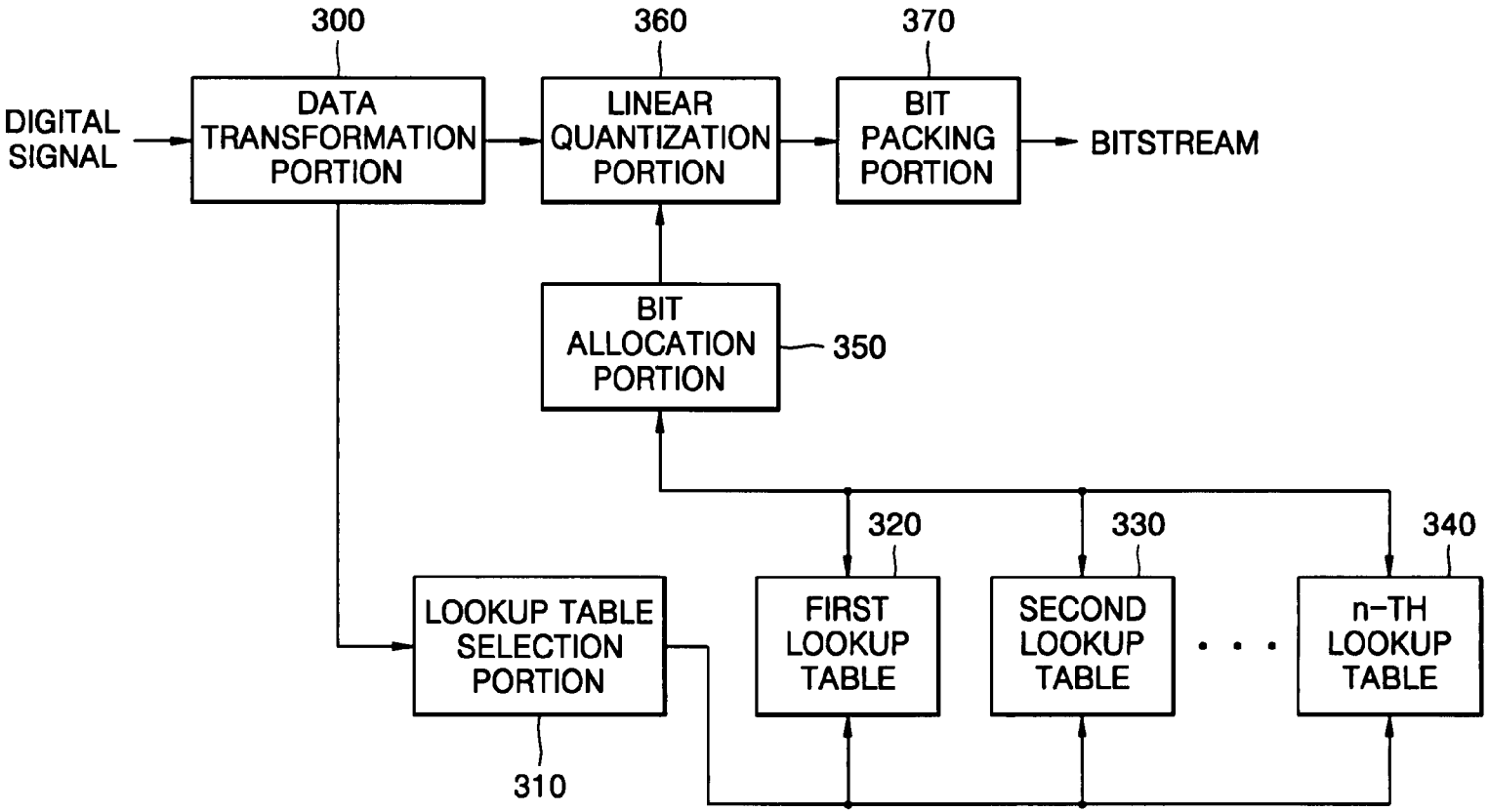
FIG. 3 is a block diagram of a digital signal encoding apparatus using a plurality of lookup tables and linear quantization by sections, according to an embodiment of the present invention.

Accordingly, an embodiment of the present invention provides encoding apparatuses according to four embodiments, which are: an encoding apparatus including the improved bit allocation portion and the improved linear quantization portion; an encoding apparatus including the improved bit allocation portion and the improved bit packing portion; an encoding apparatus including the improved linear quantization portion and the improved bit packing portion; and an encoding apparatus including the improved bit allocation portion, the improved linear quantization portion, and the improved bit packing portion. First, the digital signal encoding apparatus including the improved bit allocation portion and the improved linear quantization portion will be described with reference to FIG. 3. Referring to FIG. 3, the digital signal encoding apparatus includes a data transformation portion 300, a lookup table selection portion 310, first through n-th lookup tables 320, 330, and 340, a bit allocation portion 350, a linear quantization portion 360, and a bit packing portion 370.

The data transformation portion 300 transforms a digital input signal to remove redundant information among signals. The digital input signal may be a pulse-code modulation (PCM) sampled signal. The PCM sampled signal, which is a time-domain input signal, is transformed into a frequency-domain signal, which is divided by a predetermined number of frequency bands, using sub-band filters. The digital input signal is quantized in units of a frequency band. Hereinafter, the frequency bands will be used as an example of a quantization unit. The digital signal, for example, the PCM sampled signal, may be transformed through discrete cosine transform (DCT), modified DCT (MDCT), fast Fourier transform (FFT), or the like, instead of using the sub-band filters, so that redundant information can be removed from data.

The lookup tables 320, 330, and 340 are produced based on characteristics of the input signal. The lookup tables 320, 330, and 340 store the numbers of bits allocated to encode quantization units of the input signal, in a predetermined number of addresses. Since the input signal is transformed using the sub-band filters, the quantization unit of the input signal is a frequency band. The characteristics of the input signal may be the number of frequency bands among the frequency bands of the input signal, whose occupancy rates are no greater than or no less than a predetermined reference value. The occupancy rate of each frequency band may be a larger value between an occupancy rate of a squared scale factor of the frequency band and an occupancy rate of a mean power of the frequency band. The addresses used in each of the lookup tables are set to values indicating characteristics of the frequency bands of the input signal. For example, the addresses used in each of the lookup tables may be set to a variance of each frequency band, a scale factor of each frequency band, a squared scale factor of each frequency band, a mean value of sampled input signals within each frequency band, a mean power of the sampled input signals within each frequency band, a larger value between an occupancy rate of the scale factor of each frequency band and an occupancy rate of the mean value of the input signals within each frequency band, or a larger value between an occupancy rate of the squared scale factor of each frequency band and an occupancy rate of the mean power of the input signals within each frequency band.

The occupancy rate of the scale factor of each frequency band, $SR_{scf}$, the occupancy rate of the mean value of the input signals within each frequency band, $SR_{mean}$, the occupancy rate of the squared scale factor, $SR_{squared_scf}$, and the occupancy rate of the mean power of the input signals within each frequency band, $SR_{mean_power}$, can be calculated as in Equation 1:

$$SR_{\text{squared_scf}}[ch][sb] = \frac{\text{squared_scf}[ch][sb]}{\sum_{ch}\sum_{sb}\text{squared_scf}[ch][sb]}$$

$$SR_{\text{mean_pwr}}[ch][sb] = \frac{\text{mean_pwr}[ch][sb]}{\sum_{ch}\sum_{sb}\text{mean_pwr}[ch][sb]}$$

wherein scf denotes a scale factor, mean denotes a mean value, ch denotes a left or right channel which calculates an occupancy rate from an audio signal, and sb denotes a frequency band having the occupancy rate.

The lookup table selection portion 310 selects one among the lookup tables 320, 330, and 340 according to the characteristics of the input signal, which have been considered when producing the lookup tables 320, 330, and 340.

The bit allocation portion 350 calculates address values for quantization units of the input signal, e.g., address values for the frequency bands of the input signal obtained using the sub-band filters, extracts numbers of allocated bits for the frequency bands corresponding to the calculated address values from the selected lookup table, and allocates the extracted numbers of bits to the corresponding frequency bands. The addresses for the frequency bands are set upon production of the lookup tables 320, 330, and 340. Hence, the bit allocation portion 350 calculates values indicating the characteristics of the frequency bands of the input signal to serve as the address values of the frequency bands.

Figure 4:
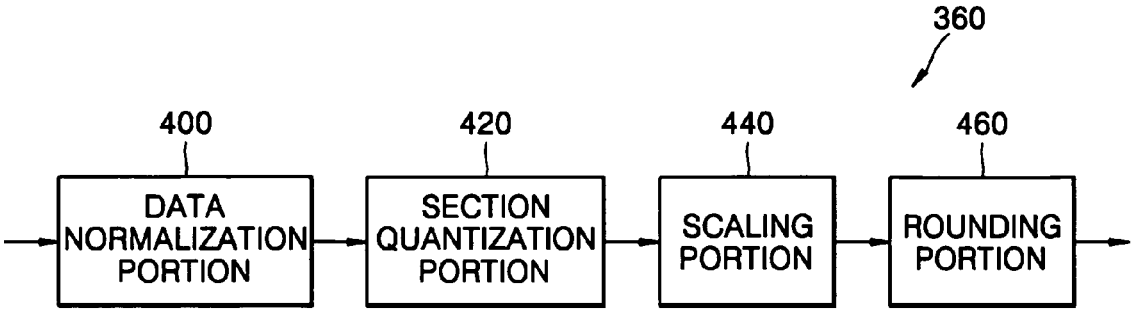
FIG. 4 is a block diagram of a detailed structure of a linear quantization portion of FIG. 3.

The linear quantization portion 360 divides a distribution of sample data values into predetermined sections based on the quantizing unit, and linearly quantizes sample data from which repeated information is removed by the data transformation portion 300, using the numbers of bits allocated for the quantization units by the bit allocation portion 350. Referring to FIG. 4, the linear quantization portion 360 includes a data normalization portion 400, a section quantization portion 420, a scaling portion 440, and a rounding portion 460.

FIG. 4 is a block diagram of a detailed structure of the linear quantization portion 360. The data normalization portion 400 normalizes the sample data produced by the data transformation portion 300, using a predetermined scale factor. The scale factor is an integer determined by a predetermined function of a value greater than or equal to a maximum absolute value among sample data values within the quantizing unit. The section quantization portion 420 divides the range of normalized values into predetermined sections, and applies linear functions to the predetermined sections of the data normalized by the data normalization portion 400. The scaling portion 440 scales values generated by the section quantization portion 420 using the numbers of bits allocated by the bit allocation portion 350. The rounding portion 460 rounds the scaled sampling values to the nearest whole number using the numbers of bits allocated and generates quantized sample data.

The bit packing portion 370 codes the data linearly quantized by the linear quantization portion 360 to produce a bit stream. The coding may be a Huffman coding.

The digital signal encoding apparatus using the plurality of lookup tables may further include a number-of-bits adjuster (not shown). The number-of-bits adjuster calculates the number of allocated bits for an entire input signal, which is a sum of the numbers of bits allocated to the frequency bands by the bit allocation portion 350, compares the calculated number of allocated bits with a required number of bits to be allocated for the entire input signal, which is determined by an encoding rate required by the encoding apparatus, and adjusts the number of bits allocated to each of the frequency bands according to the comparison result.

Figure 5:
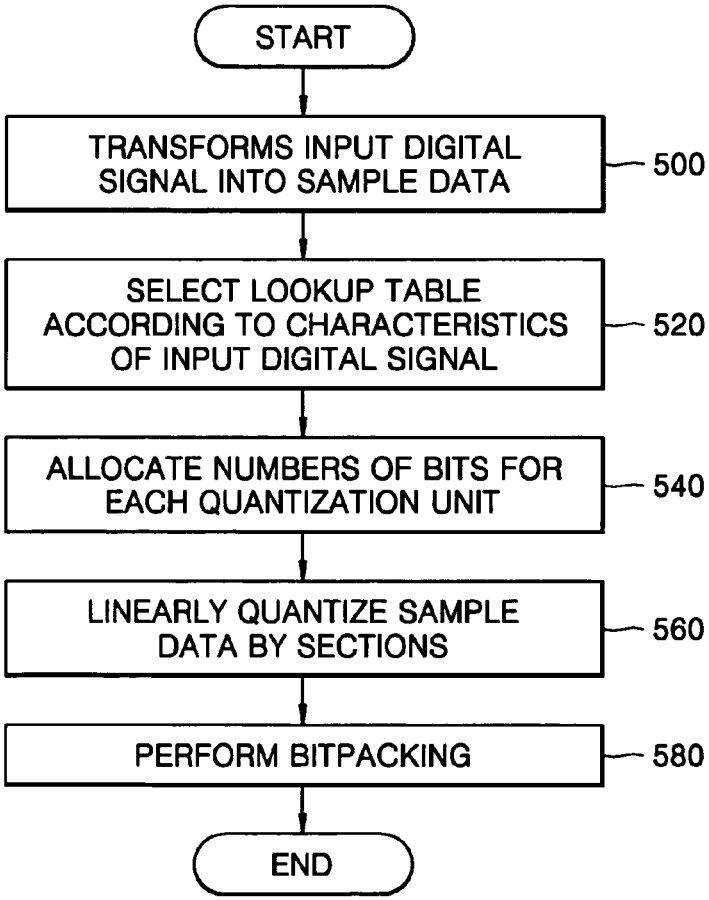
FIG. 5 is a flowchart illustrating a digital signal encoding method using a plurality of lookup tables and linear quantization by sections, according to an embodiment of the present invention.

FIG. 5 is a flowchart illustrating a digital signal encoding method performed in the digital signal encoding apparatus of FIG. 3, according to an embodiment of the present invention. Referring to FIGS. 3 and 5, first, the data transformation portion 300 transforms an input digital signal so that redundant information can be removed from the input digital signal, in operation 500. For example, a time-domain digital input signal is transformed into a predetermined number of frequency bands using sub-band filters, which serve as a band analysis filter.

In operation 520, the bit allocation portion 350 calculates address values of the frequency bands of the input signal, which are quantization units. The address values of the frequency bands indicate characteristics of the frequency bands set as addresses when the lookup tables 320, 330 and 340 are produced. Each of the address values may be a variance of each frequency band, a scale factor of each frequency band, a squared scale factor of each frequency band, a mean value of input signals in each frequency band, a mean power of input signals in each frequency band, a larger value between an occupancy rate of a scale factor of each frequency band and an occupancy rate of a mean value of input signals in each frequency band, or a larger value between an occupancy rate of a squared scale factor of each frequency band and an occupancy rate of a mean power of input signals in each frequency band.

Relations between characteristics of frequency bands, which can be set as the address values of the frequency bands, and the number of allocated bits for each frequency band will now be described. A variance characteristic shows how near a distribution of an input signal is to an average distribution. If the variance is large, a dynamic area of the input signal is large. Accordingly, to reduce quantization noise, more bits must be allocated. If the variance is relatively small, even though the bit allocation amount is small, not as much quantization noise is generated. A mean power characteristic has a similar concept to a mean characteristic. However, because a mean value of an input signal is generally 0 in a case of a sine wave, a mean power value instead of the mean value is used as a characteristic of a frequency band. More bits are allocated to a frequency band whose mean power value is large. A scale factor is defined as a value corresponding to the largest sample value per frequency band, and more bits are allocated to a frequency band whose scale factor is large.

Still in operation 520, the lookup table selection portion 310 selects one of the plurality of lookup tables 320, 330 and 340 according to the characteristic of the input digital signal. The characteristic of the input signal, which is a basis of the lookup table selection, is considered when the plurality of lookup tables 320, 330 and 340 are produced, and may be set to the number of frequency bands among the frequency bands of the input signal, whose occupancy rates are no more than or no less than a predetermined reference value. The occupancy rate of each frequency band may be set to a larger value between an occupancy rate of a scale factor of each frequency band and an occupancy rate of a mean value of input signals in each frequency band or a larger value between an occupancy rate of a squared scale factor of each frequency band and an occupancy rate of a mean power of input signals in each frequency band, which are calculated in Equation 1.

Figure 6:
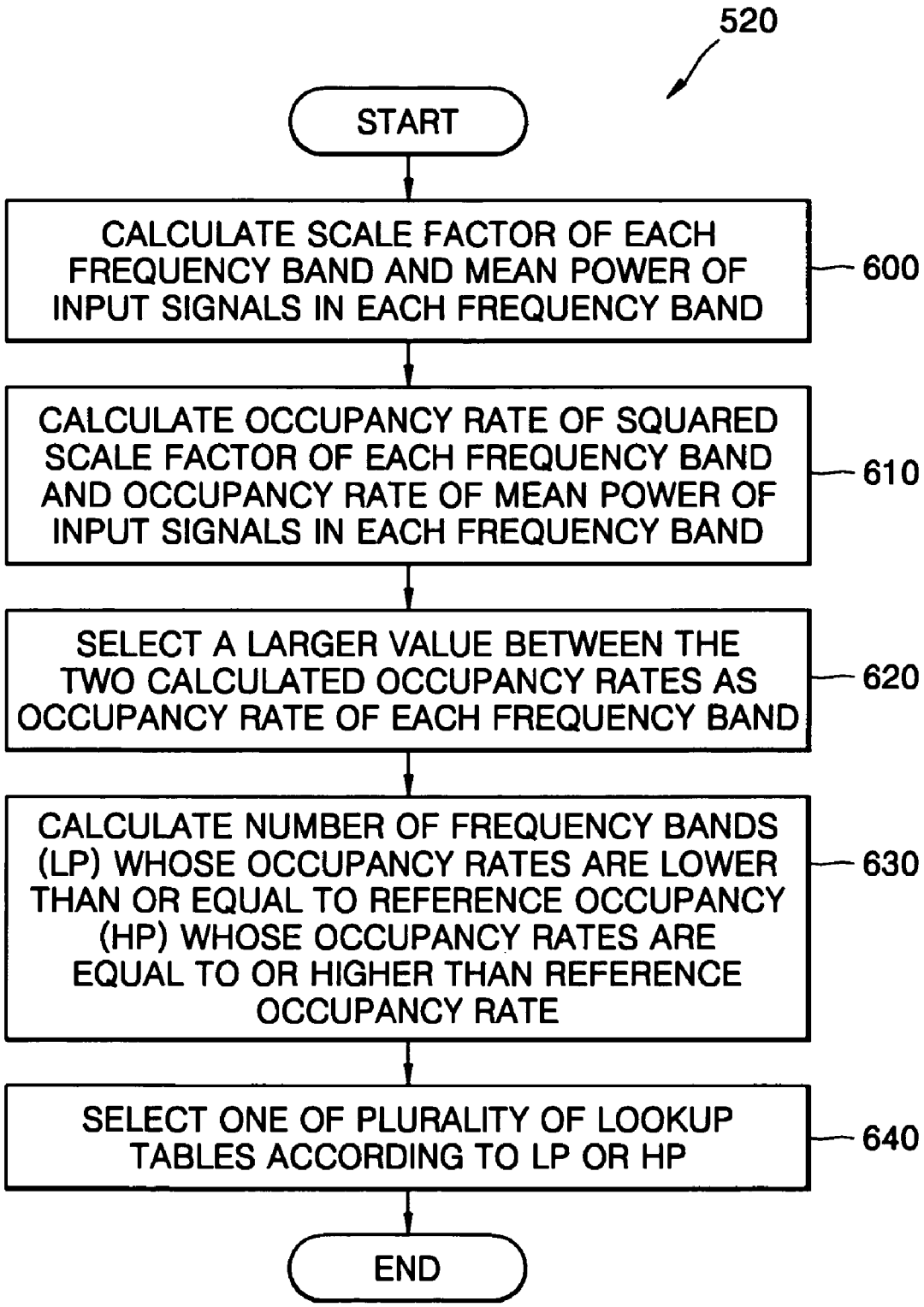
FIG. 6 is a flowchart illustrating an embodiment of an operation of selecting one of the lookup tables illustrated in FIG. 5.

FIG. 6 is a flowchart illustrating an embodiment of an operation of selecting one of the lookup tables illustrated in FIG. 5 (operation 520). Referring to FIG. 6, a scale factor of each frequency band and a mean power of input signals in each frequency band are calculated in operation 600. Then, an occupancy rate of a squared scale factor of each frequency band and an occupancy rate of a mean power of input signals in each frequency band are calculated as shown in Equation 1, in operation 610.

Thereafter, a larger value between the two calculated occupancy rates is selected as an occupancy rate of each frequency band, in operation 620. Next, the number of frequency bands (LP) whose occupancy rates are lower than or equal to a predetermined reference occupancy rate and the number of frequency bands (HP) whose occupancy rates are equal to or higher than the predetermined reference occupancy rate are calculated, in operation 630. The numbers of frequency bands, LP and HP, serve as values indicating the characteristics of the input signal on which the lookup table selection is based.

In operation 640, one of a plurality of lookup tables is selected according to the numbers of frequency bands, LP and HP, which indicate the characteristics of the input signal. If the number of frequency bands, LP, is large, sampled input signals are concentrated in a specific frequency band. Accordingly, a lookup table indicating allocation of more bits for frequency bands where sampled input signals are concentrated is selected. Also, if the number of frequency bands, HP, is small, sampled input signals are concentrated in a specific frequency band. Accordingly, a lookup table indicating allocation of more bits for frequency bands where sampled input signals are concentrated is selected.

Figure 7A:
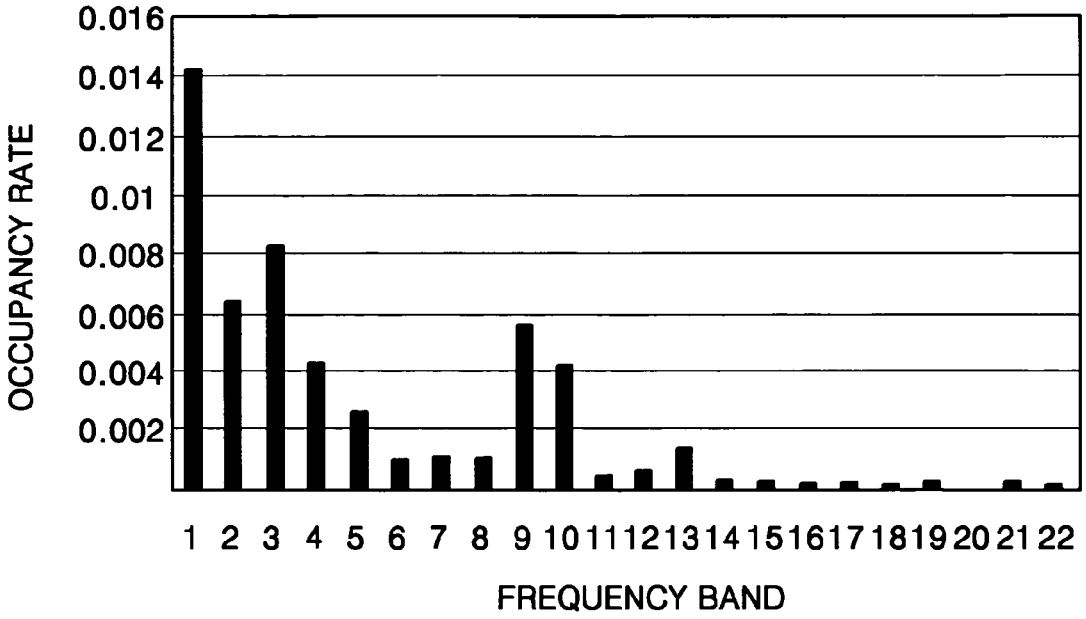
FIGS. 7A and 7B are graphs illustrating occupancy rates for frequency bands of an input signal.
Figure 7B:
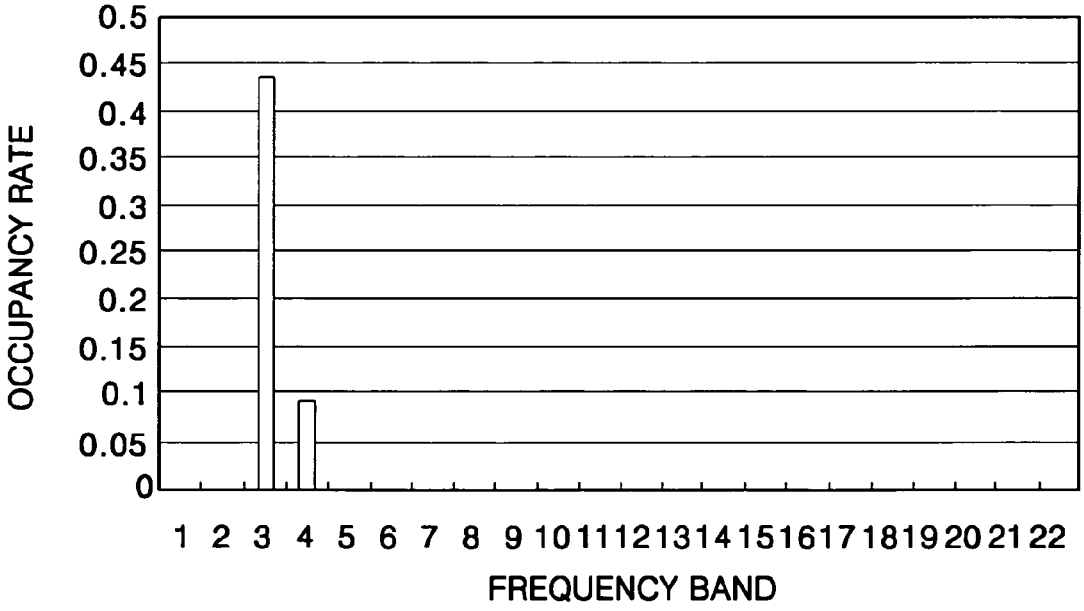

FIGS. 7A and 7B are graphs showing occupancy rates of frequency bands of an input signal. FIG. 7A deals with sampled input signals having a general characteristic. Referring to FIG. 7A, since LP is small and HP is large, a lookup table indicating allocation of similar numbers of bits for all frequency bands is selected.

FIG. 7B deals with sampled input signals which are concentrated in a specific frequency band. Referring to FIG. 7B, since LP is large and HP is small, a lookup table indicating allocation of many bits for a specific frequency band is selected.

After a suitable lookup table is selected according to the characteristics of the input digital signal in operation 520, the bit allocation portion 350 extracts the numbers of allocated bits corresponding to the address values for the frequency bands from the selected lookup table and allocates the numbers of bits to the frequency bands, in operation 540.

To match the total number of bits allocated for the encoded input signal to the number of bits required to be allocated, which depends on a compression rate, an operation of adjusting the number of bits allocated for each frequency band may be performed after operation 540. This operation will now be described in detail with reference to FIG. 8.

Figure 8:
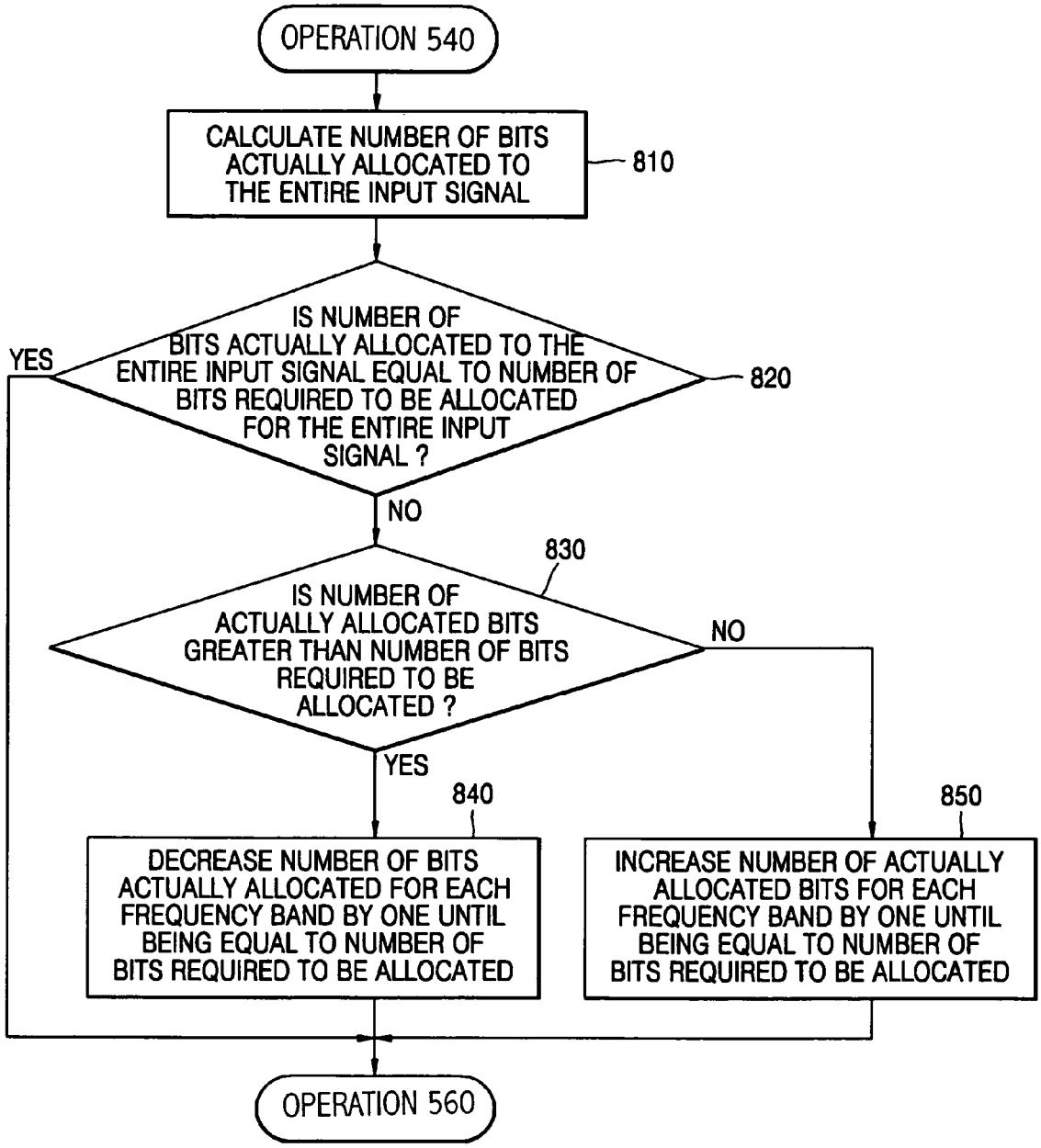
FIG. 8 is a flowchart illustrating an embodiment of an operation of allocating a number of bits allocated to each frequency band illustrated in FIG. 5.

FIG. 8 is a flowchart illustrating an operation of matching a number of bits actually allocated to an input signal to a number of bits required to be allocated to the input signal, after operation 540 of FIG. 5. Referring to FIG. 8, after bits, the number of which is obtained from the selected lookup table, are allocated to each frequency band in operation 540 of FIG. 5, the number of bits actually allocated to the entire input signal is calculated by summing the numbers of bits allocated to the frequency bands, in operation 810.

In operation 820, it is determined whether the number of bits actually allocated to the entire input signal, which is calculated in operation 810, is equal to the number of bits required to be allocated, which depends upon a compression rate for encoding. For example, when the total number of bits for the input signal is 100 and a compression rate is 50%, 50 bits are required to be allocated for the input signal. If the number of bits actually allocated to the entire input signal is equal to the number of bits required to be allocated, bits are allocated to each frequency band according to the numbers of bits allocated in operation 540.

On the other hand, if the number of bits actually allocated to the entire input signal is different from the number of bits required to be allocated, another determination is made as to whether the number of actually allocated bits is greater than the number of bits required to be allocated, in operation 830. If the number of actually allocated bits is greater than the number of bits required to be allocated, the number of actually allocated bits for each frequency band decreases 1 until being equal to the number of bits required to be allocated, in operation 840. If the number of actually allocated bits is smaller than the number of bits required to be allocated, the number of actually allocated bits for each frequency band increases 1 until being equal to the number of bits required to be allocated, in operation 850.

Referring back to FIG. 5, when the number of bits to be allocated for each frequency band is finally determined, the distribution of digital signal values for each quantization unit, for example, each frequency band obtained when using sub-band filters, is divided into predetermined sections, and the digital signal values in each section are linearly quantized using the number of bits to be allocated for each quantization unit, in operation 560.

Figure 9:
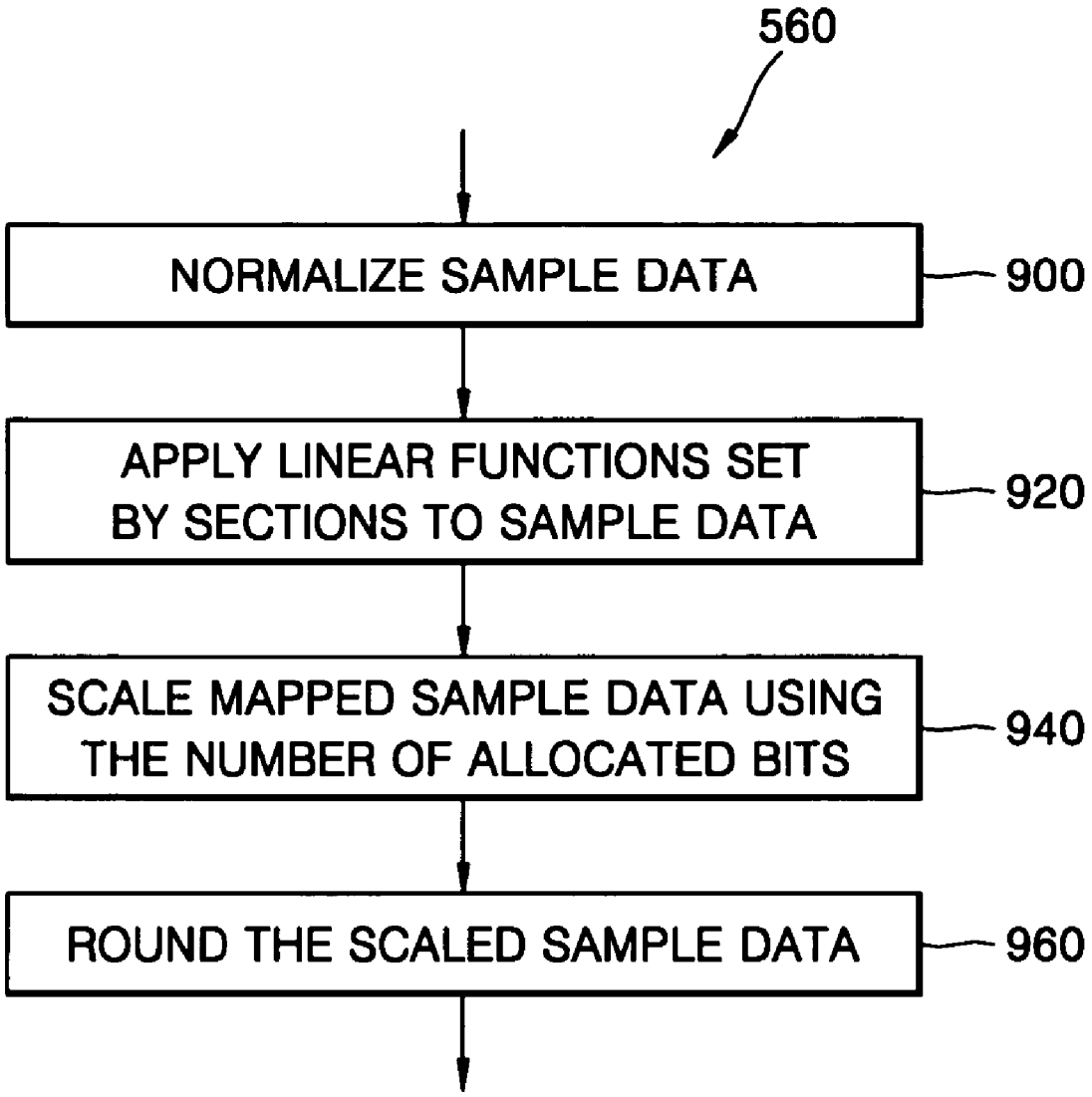
FIG. 9 is a flowchart illustrating operation 560 shown in FIG. 5.

FIG. 9 is a flowchart illustrating operation 560 shown in FIG. 5. Referring to FIGS. 4 and 9, first, the data normalization portion 400 normalizes sample data obtained by the data transformation portion 300, using a scale factor of each quantization unit, that is, each frequency band obtained when using sub-band filters, in operation 900. For example, assume that the output sample values that are sub-band filtered using the subband filters of the data transformation portion 300 are 24, −32, 4, and 10. The maximum absolute value of the output sample values is 32. When the sample values are normalized using a scale factor corresponding to the maximum value 32, the sample values become 0.75, −1, 0.125, and 0.3125. Here, the scale factor may be determined as follows. In a predetermined formula $2^{x/4}$, wherein x is a scale factor, when x is incremented by one from 0 to 31, the value of the formula $2^{x/4}$ is determined according to 32 values of x. That is, if x=0, the value of the formula $2^{x/4}$ is 1, if x=1, the value of the formula $2^{x/4}$ is 1.18, if x=2, the value of the formula $2^{x/4}$ is 1.414, is x=3, the value of the formula $2^{x/4}$ is 1.68, if x=4, the value of the formula $2^{x/4}$ is 2, etc. When all the values of the formula $2^{x/4}$ are calculated, it can be seen that as x increments by one, the value of the formula $2^{x/4}$ increments by 1.5 dB. In the present example, if the value of the formula $2^{x/4}$ corresponding to the absolute maximum value 32 is 32, the scale factor x will be 20. Therefore, one value of the scale factor is determined in each subband.

Figure 10:
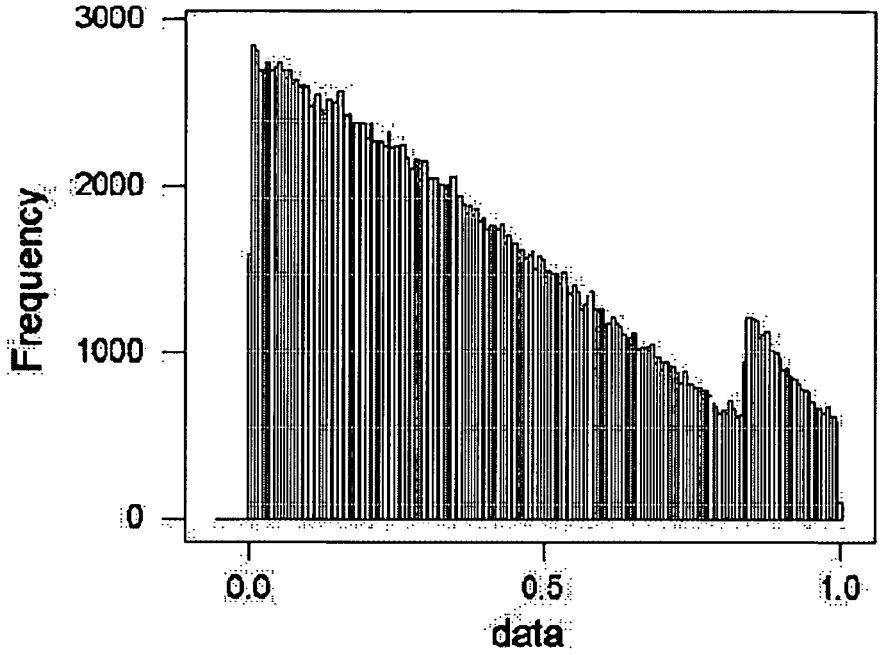
FIG. 10 illustrates a distribution of sub-band samples obtained by normalizing sample data.

FIG. 10 is a graph illustrating the distribution of subband samples used to normalize the sample data. The normalized samples, as shown in FIG. 10, are not uniformly distributed. Therefore, they cannot be optimally quantized using a linear quantizer.

Figure 11:
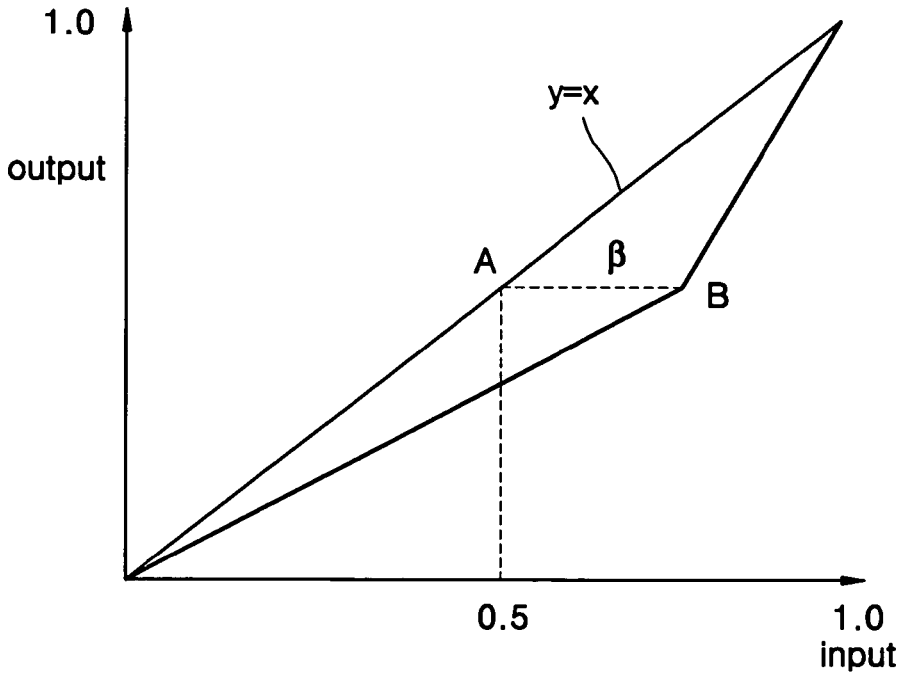
FIG. 11 is a graph illustrating two sections into which the range of normalized values is divided.

Therefore, the section quantizing portion 420 divides the range of the normalized values into predetermined sections and transforms the sample data normalized in operation 900 by applying linear functions set for the predetermined sections to the sample data, in operation 920. For example, the range of the normalized values in FIG. 10 is 0.0-1.0, and FIG. 11 illustrates the normalized value range divided into two sections. In the graph of FIG. 11 illustrating a linear function given by y=x, a point away from a point A on the graph y=x corresponding to the mid point (x=0.5) on the x-axis by β in the x-axis direction is indicated by B. Thus, if β is 0.1, the x-axis is divided into two sections: one section from 0-0.6 (section1) and the other section from 0.6 to 1.0 (section 2). Two linear functions are applied to the two sections in such a way that one linear function is applied to one section. The value of β may be set according to the distribution of samples. β indicates how much the linear function y=x at the middle point of the normalized value range is inclined with respect to the x-axis. In another form, β may indicate how much the linear function y=x at the middle point of the normalized value range is inclined with respect to the y-axis.

The linear functions can generally be expressed as $$y = \frac{ax}{(a-2b)}$$

and $$y = \frac{x}{(1+2b)} + \frac{2b}{(1+2b)}.$$

Here, a denotes the range of normalized values, and b denotes section displacement from the center of a. In the present example, if the β is 0.1, a first linear function $y=f_1(x)$ is y=⅚×x in section 1, and a second linear function $y=f_2(x)$ is $y=\frac{5}{4}x-\frac{1}{4}$ in section 2. The linear functions are applied to sample values in the corresponding sections. In the present example, the sample values 0.125 and 0.3125 are included in section 1 and mapped by applying the first linear function $y=f_1(x)$, and the sample values 0.75 and −1 are included in section 2 and mapped by applying the second linear function $y=f_2(x)$.

In operation 940, the mapped values are scaled in the scaling portion 440 using the number of bits allocated by the bit allocating portion 350. For example, if the bit allocation information is 3, the sample values mapped by applying the linear functions of the corresponding sections are multiplied by 8, since 0 through 7 can be expressed.

In operation 960, the sample values scaled in operation 940 are rounded to obtain quantized sample values. The rounded value is always an integer. For example, if the number of bits to be allocated is 3, a rounded value is one from 0 to 7, is expressed with 3 bits, and is the final quantized sample value.

Figure 12:
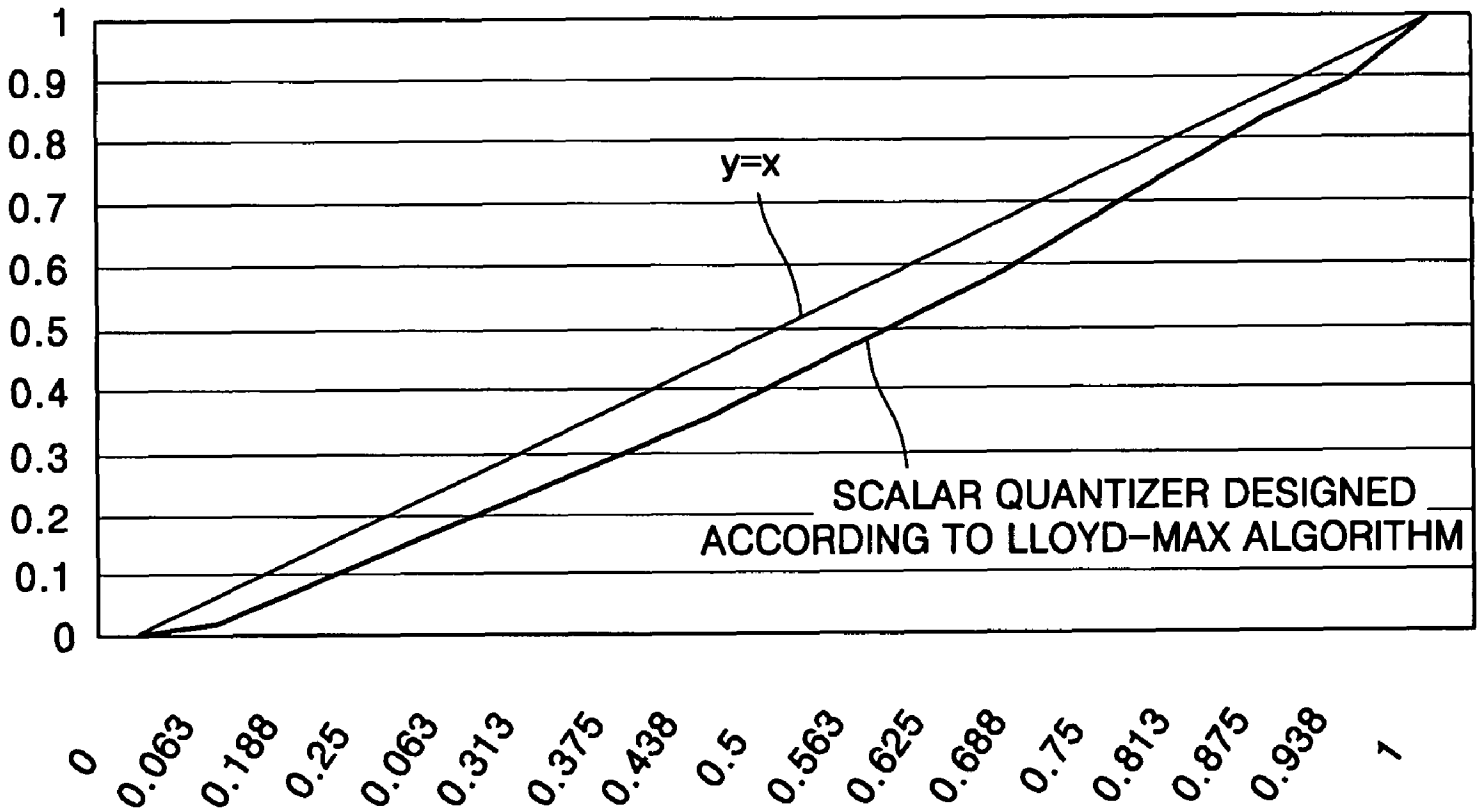
FIG. 12 is a graph illustrating a quantizer designed according to a Lloyd-Max algorithm based on the distribution of FIG. 10

FIG. 12 is a graph produced using a quantizer designed according to a Lloyd-Max algorithm based on the distribution of FIG. 10. As illustrated in FIG. 12, the produced graph bulges downwards toward the x-axis from the linear function y=x.

Referring back to FIG. 5, in operation 580, the data linearly quantized as described above together with side information is encoded into a bit stream using a data encoding method, such as, a Huffman encoding, in the bit packing portion 370 of FIG. 3. Preferably, the side information includes a scale factor of each frequency band and the number of bits allocated for each frequency band.

Figure 13:
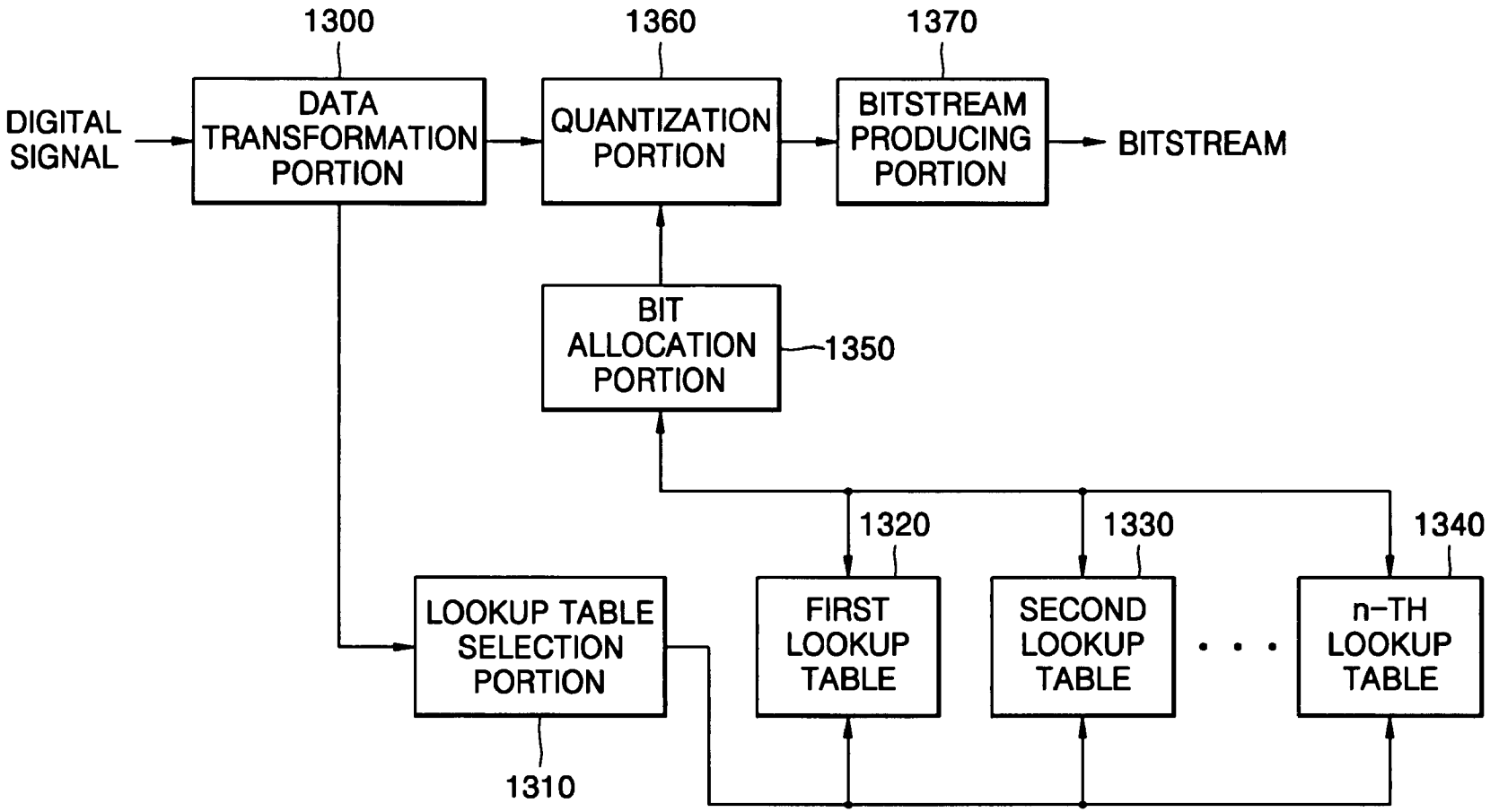
FIG. 13 is a block diagram of a digital signal encoding apparatus having improvements in a bit allocation portion and a bit packing portion, according to another embodiment of the present invention.

Hereinafter, a digital signal encoding apparatus having improvements in a bit allocation portion and a bit packing portion will be described with reference to FIG. 13. Referring to FIG. 13, this digital signal encoding apparatus includes a data transformation portion 1300, a lookup table selection portion 1310, a plurality of lookup tables 1320, 1330, and 1340, a bit allocation portion 1350, a quantization portion 1360, and a bitstream producing portion 1370.

The data transformation portion 1300, the lookup table selection portion 1310, the lookup tables 1320, 1330, and 1340, and the bit allocation portion 1350 operate equally to the data transformation portion 300, the lookup table selection portion 310, the lookup tables 320, 330, and 340, and the bit allocation portion 350 of FIG. 3, respectively, so they will not be described again.

The quantization portion 1360, which is a general quantizer, quantizes the input signal using bits allocated for each quantization unit, e.g., each frequency band when using sub-band filters.

The bitstream producing portion 1370 produces a bitstream comprised of frames from the quantized data and side information. Information about a frame length is located at a tail portion of the bitstream. Preferably, the side information includes a scale factor for each frequency band and the number of bits allocated for each frequency band.

Figure 14:
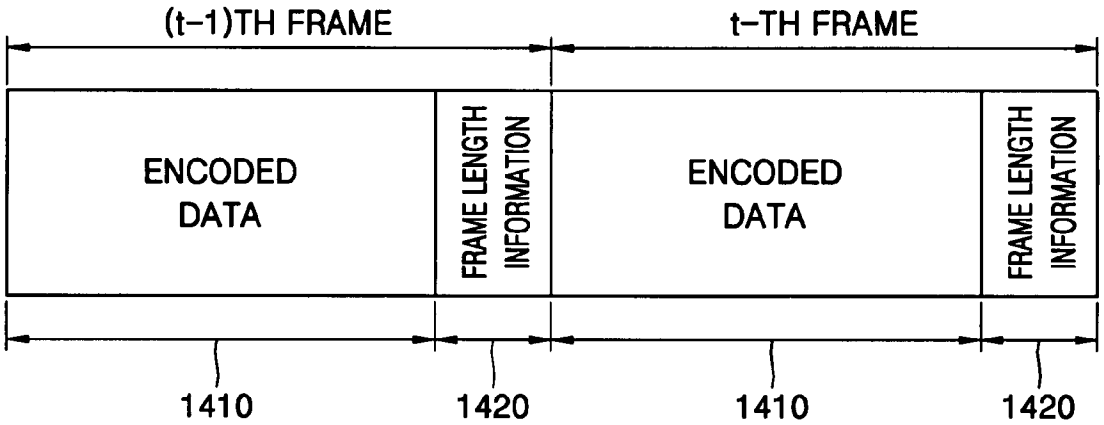
FIG. 14 illustrates an example of a frame structure of a bitstream.
Figure 15:
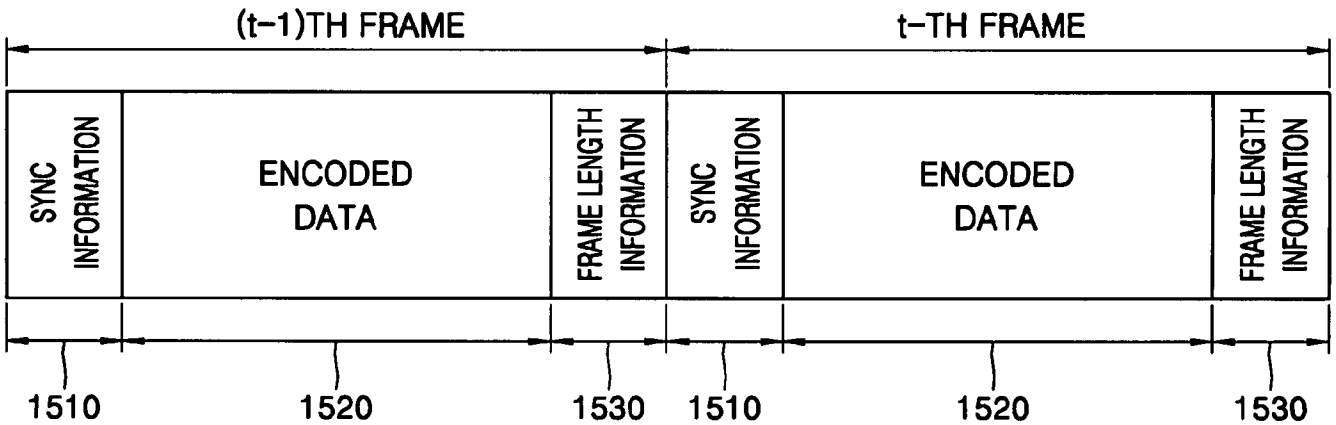
FIG. 15 illustrates another example of a frame structure of a bitstream.

FIG. 14 illustrates an example of a frame structure of a bitstream. Each frame is comprised of a first area 1410, which stores encoded data, and a second area 1420, which stores encoded information about a frame length. A size of the second area 1420 is constant for all frames, and a size of the first area 1410 may vary when an encoding rate of frames is a variable bitrate. FIG. 15 illustrates another example of a frame structure of a bitstream. Each frame is comprised of a first area 1510, which stores sync information, a second area 1520, which stores encoded data, and a third area 1530, which stores encoded information about a frame length. Sizes of the first and third area 1510 and 1530 are constant for all frames, and a size of the second area 1520 may vary when an encoding rate of frames is a variable bitrate. When a frame includes sync information as in the example of FIG. 15, and a digital signal reproducing apparatus receives an external impact during reproduction of a digital signal, a reverse search for effective data to be reproduced can become more reliable and more accurate.

The digital signal encoding apparatus of FIG. 13 may further include a number-of-bits adjusting portion (not shown). The number-of-bits adjusting portion calculates the number of allocated bits for an entire input signal, which is a sum of the numbers of bits allocated to the frequency bands by the bit allocation portion 1350, compares the calculated number of allocated bits with a required number of bits to be allocated for the entire input signal, which is determined by an encoding rate required by the encoding apparatus, and adjusts the number of bits allocated for each of the frequency bands according to the comparison result.

Figure 16:
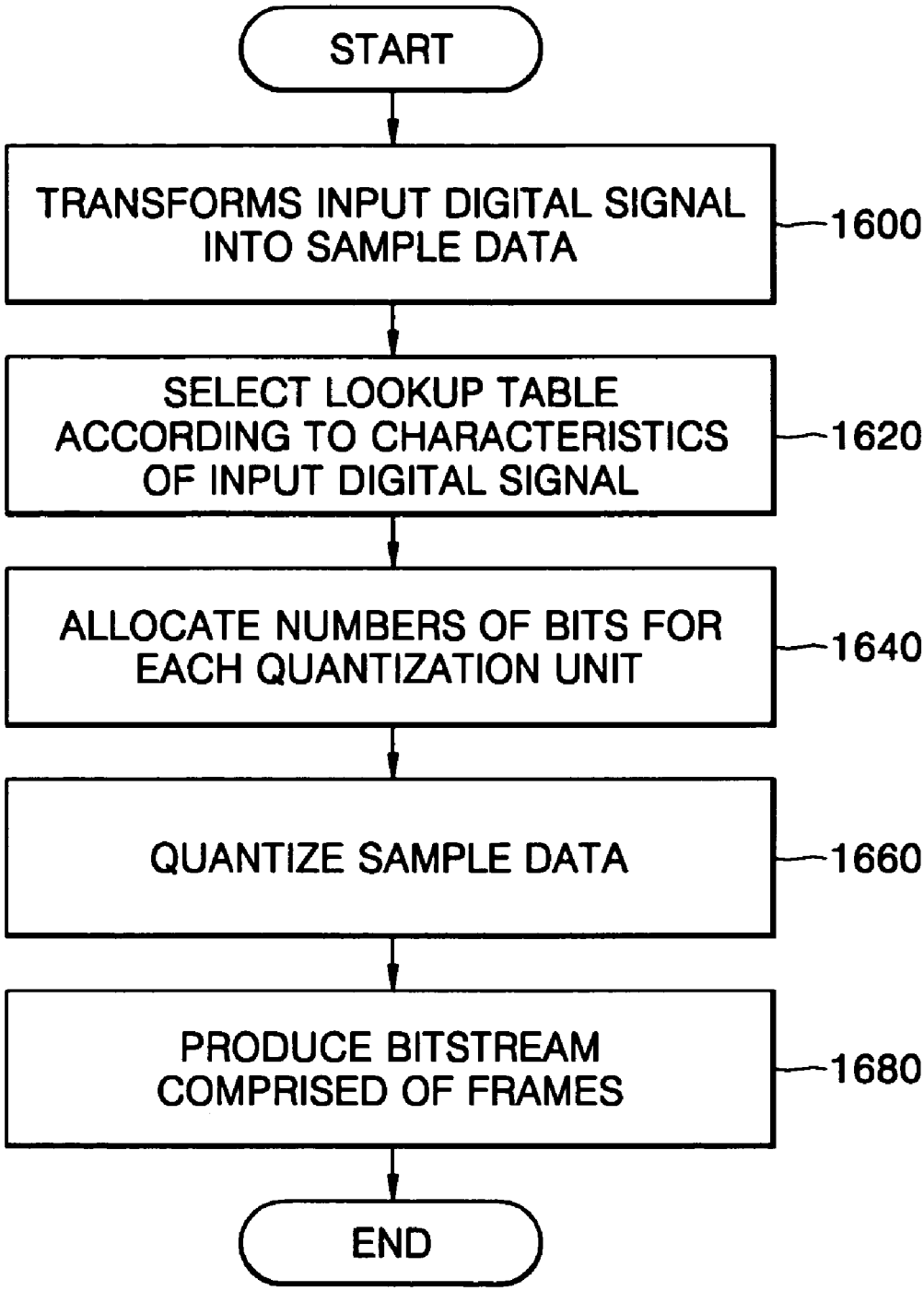
FIG. 16 is a flowchart illustrating a digital signal encoding method in which a bit stream including frame length information is produced using a plurality of lookup tables, according to another embodiment of the present invention.

FIG. 16 is a flowchart illustrating a digital signal encoding method in which a bit stream including frame length information is produced using a plurality of lookup tables, according to another embodiment of the present invention. This digital signal encoding method will now be described by referring to FIGS. 13 and 16.

Operations 1600 through 1640 are the same as operations 500 through 540 of FIG. 5, so they will not be described herein.

To match the total number of bits allocated for the encoded input signal to a required number of bits to be allocated, which depends on a compression rate, an operation of comparing the total number of bits allocated for the encoded input signal with the required number of bits to be allocated and adjusting the number of bits allocated for each frequency band according to a result of the comparison may be performed after operation 1640.

After bits are allocated to each frequency band in operation 1640 or after the number of bits allocated to each frequency band is adjusted as necessary, data transformed by the data transformation portion 1300 is quantized, for example, in units of a frequency band when using sub-band filters, using the number of bits allocated to each frequency band, in operation 1660.

Thereafter, a bitstream comprised of frames is produced from the quantized data and predetermined side information in the bitstream producing portion 1370, in operation 1680. Each frame in a bitstream includes information about a frame length located in a tail area of the frame as shown in FIG. 14 and may further include sync information used for inter-frame synchronization located in a head area of the frame as shown in FIG. 15. Preferably, the predetermined side information includes a scale factor of each band and the number of bits allocated for each band.

Figure 17:
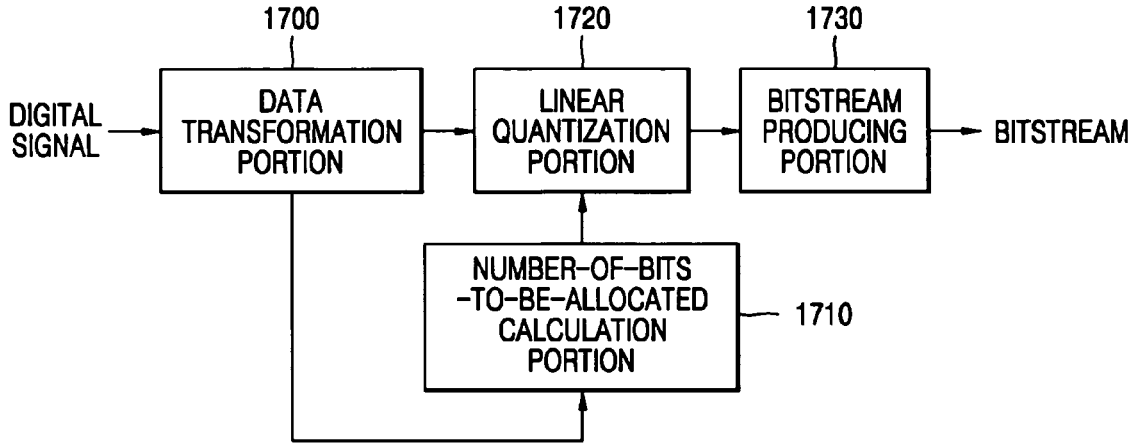
FIG. 17 is a block diagram of a digital signal encoding apparatus having improvements in a linear quantization portion and a bit packing portion, according to another embodiment of the present invention.

FIG. 17 is a block diagram of a digital signal encoding apparatus having improvements in a linear quantization portion and a bit packing portion, according to another embodiment of the present invention. This digital signal encoding apparatus includes a data transformation portion 1700, a number-of-bits-to-be-allocated calculation portion 1710, a linear quantization portion 1720, and a bitstream production portion 1730.

The data transformation portion 1700 and the linear quantization portion 1720 operate equally to the data transformation portion 300 and the linear quantization portion 360 of FIG. 3, respectively, and the bitstream production portion 1730 operates equally to the bitstream production portion 1370 of FIG. 13. Accordingly, the data transformation portion 1700, the linear quantization portion 1720, and the bitstream production portion 1730 will not be described herein.

The number-of-bits-to-be-allocated calculation portion 1710 is the same as a bit allocation portion of a general digital signal encoding apparatus. In other words, the number-of-bits-to-be-allocated calculation portion 1710 calculates the number of bits to be allocated for each quantization unit in consideration of the importance of a signal. Also, the number-of-bits-to-be-allocated calculation portion 1710 omits detailed information lowly sensitive to humans using hearing characteristics of humans and differentiates the numbers of bits to be allocated for frequency bands so that the amount of data to be encoded can be reduced. Preferably, the number-of-bits-to-be-allocated calculation portion 1710 calculates the numbers of bits to be allocated for frequency bands, in consideration of the psychoacoustic perspective.

Figure 18:
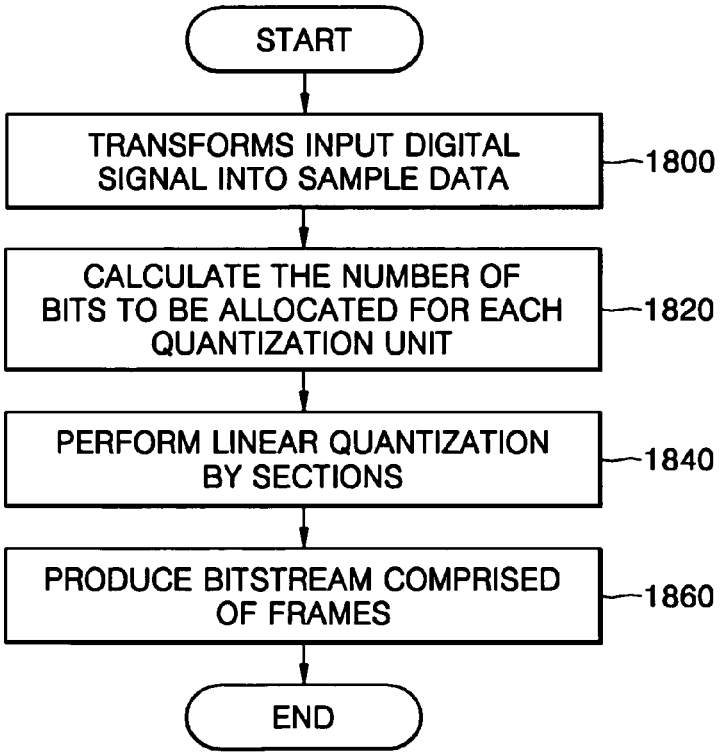
FIG. 18 is a flowchart illustrating a digital signal encoding method in which a bit stream including frame length information is produced using linear quantization by sections, according to another embodiment of the present invention.

FIG. 18 is a flowchart illustrating a digital signal encoding method in which a bit stream including frame length information is produced using linear quantization by sections, according to another embodiment of the present invention. This digital signal encoding method will now be described with reference to FIGS. 17 and 18.

Operations 1800 and 1840 of FIG. 18 are the same as operations 500 and 540 of FIG. 5, and operation 1860 of FIG. 18 is the same as operation 1680 of FIG. 16. Hence, operations 1800, 1840, and 1860 will not be described in detail herein. When a digital audio signal is transformed so that redundant information is removed from the digital signal in operation 1800, the number-of-bits-to-be-allocated calculation portion 1710 calculates the number of bits to be allocated for each quantization unit considering the importance of the audio signal, in operation 1820. For example, the quantization unit may be a sub-band when using sub-band filters. The importance of the digital signal, particularly, the audio signal, is decided considering the psychoacoustic perspective based on hearing characteristics of humans. Therefore, more bits are allocated to frequencies to which humans are highly sensitive and fewer bits are allocated to rest of the frequencies.

After the number of bits to be allocated for each frequency band is calculated in 1820, linear quantization by sections is performed in operation 1840, and a bitstream including information about a frame length is produced in operation 1860.

Figure 19:
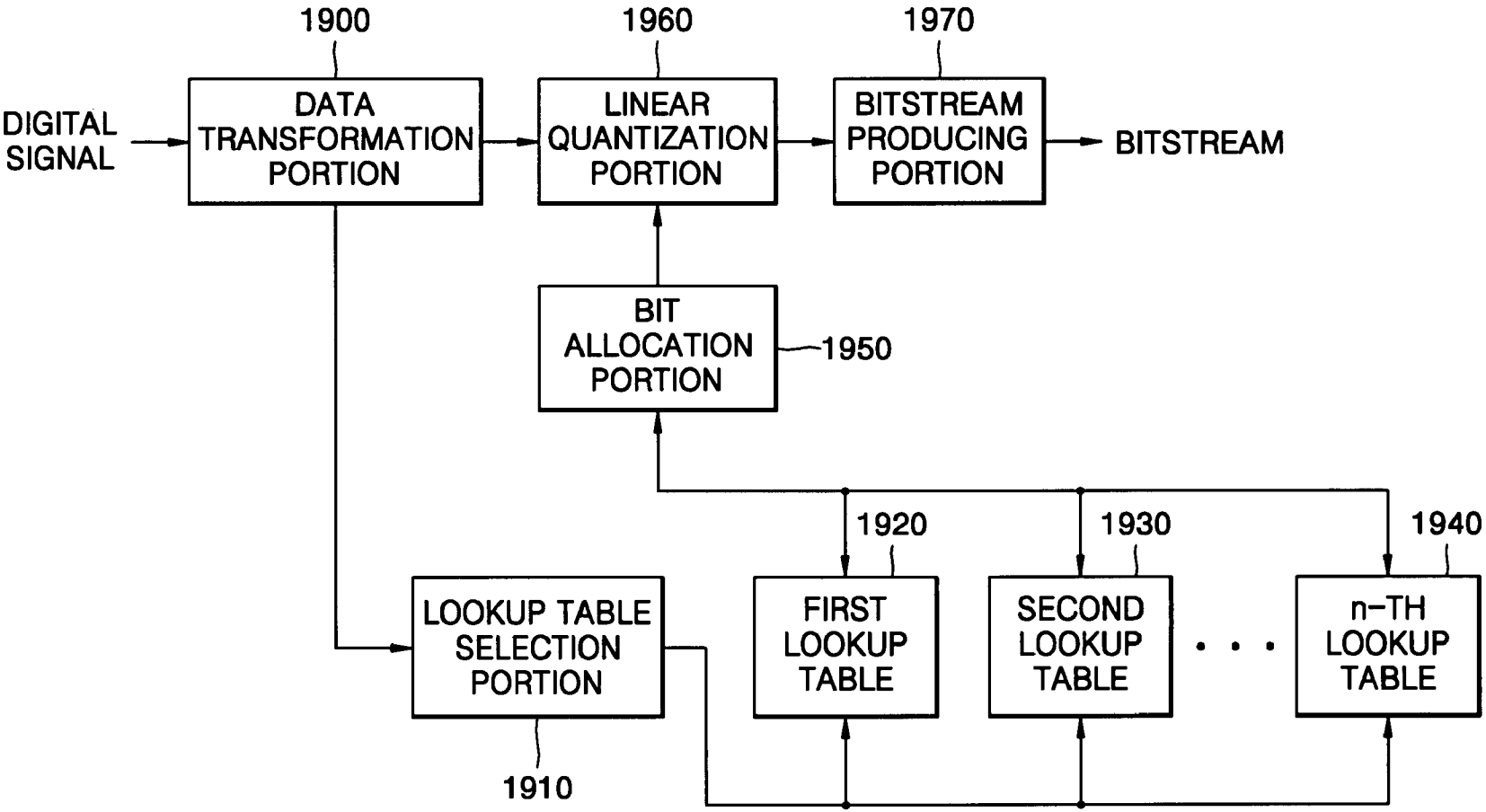
FIG. 19 is a block diagram of a digital signal encoding apparatus having improvements in a lookup table, a bit allocation portion, and a bit packing portion, according to another embodiment of the present invention.

FIG. 19 is a block diagram of a digital signal encoding apparatus having improvements in a lookup table, a bit allocation portion, and a bit packing portion, according to another embodiment of the present invention. This digital signal encoding apparatus includes a data transformation portion 1900, a lookup table selection portion 1910, a plurality of lookup tables 1920, 1930, and 1940, a bit allocation portion 1950, a linear quantization portion 1960, and a bitstream producing portion 1970.

The data transformation portion 1900, the lookup table selection portion 1910, the lookup tables 1920, 1930, and 1940, the bit allocation portion 1950, and the linear quantization portion 1960 are the same as the data transformation portion 300, the lookup table selection portion 310, the lookup tables 320, 330, and 340, the bit allocation portion 350, and the linear quantization portion 360 of FIG. 3, respectively, in their functions and operations. The bitstream producing portion 1970 is the same as the bit packing portion 1370 of FIG. 13 in its function and operation. Hence, these elements of the digital signal encoding apparatus of FIG. 19 will not be described herein.

The digital signal encoding apparatus of FIG. 19 may include the above-described number-of-bits adjusting portion (not shown). The number-of-bits adjusting portion calculates the number of allocated bits for an entire input signal, which is a sum of the numbers of bits allocated to the frequency bands by the bit allocation portion 1950, compares the calculated number of allocated bits with a required number of bits to be allocated for the entire input signal, which is determined by an encoding rate required by the encoding apparatus, and adjusts the number of bits allocated for each of the frequency bands according to the comparison result.

Figure 20:
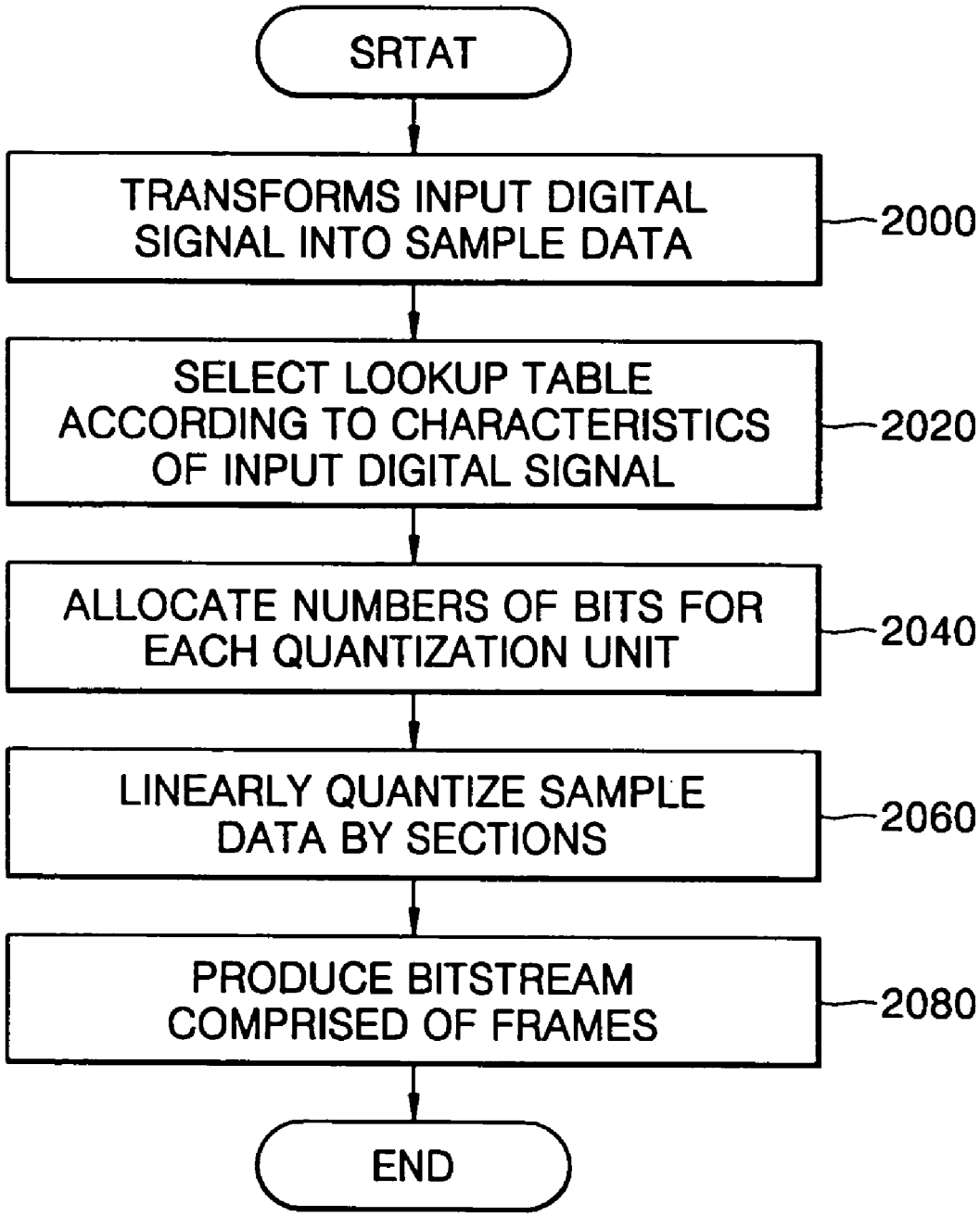
FIG. 20 is a flowchart illustrating a digital signal encoding method in which a bit stream including frame length information is produced using a plurality of lookup tables and linear quantization by sections, according to another embodiment of the present invention.

FIG. 20 is a flowchart illustrating a digital signal encoding method in which a bit stream including frame length information is produced using a plurality of lookup tables and linear quantization by sections, according to another embodiment of the present invention. This digital signal encoding method will now be described with reference to FIGS. 13 and 20. Operations 2000 through 2060 of FIG. 20 are the same as operations 500 through 560 of FIG. 5, respectively, and operation 2080 is the same as operation 1680 of FIG. 16, so they will not be described in detail herein. To match the total number of bits allocated for the encoded input signal to a required number of bits to be allocated, which depends on a compression rate, an operation of comparing the total number of bits allocated for the encoded input signal with the required number of bits to be allocated and adjusting the number of bits allocated for each frequency band according to a result of the comparison may be performed after operation 2040.

Figure 21:
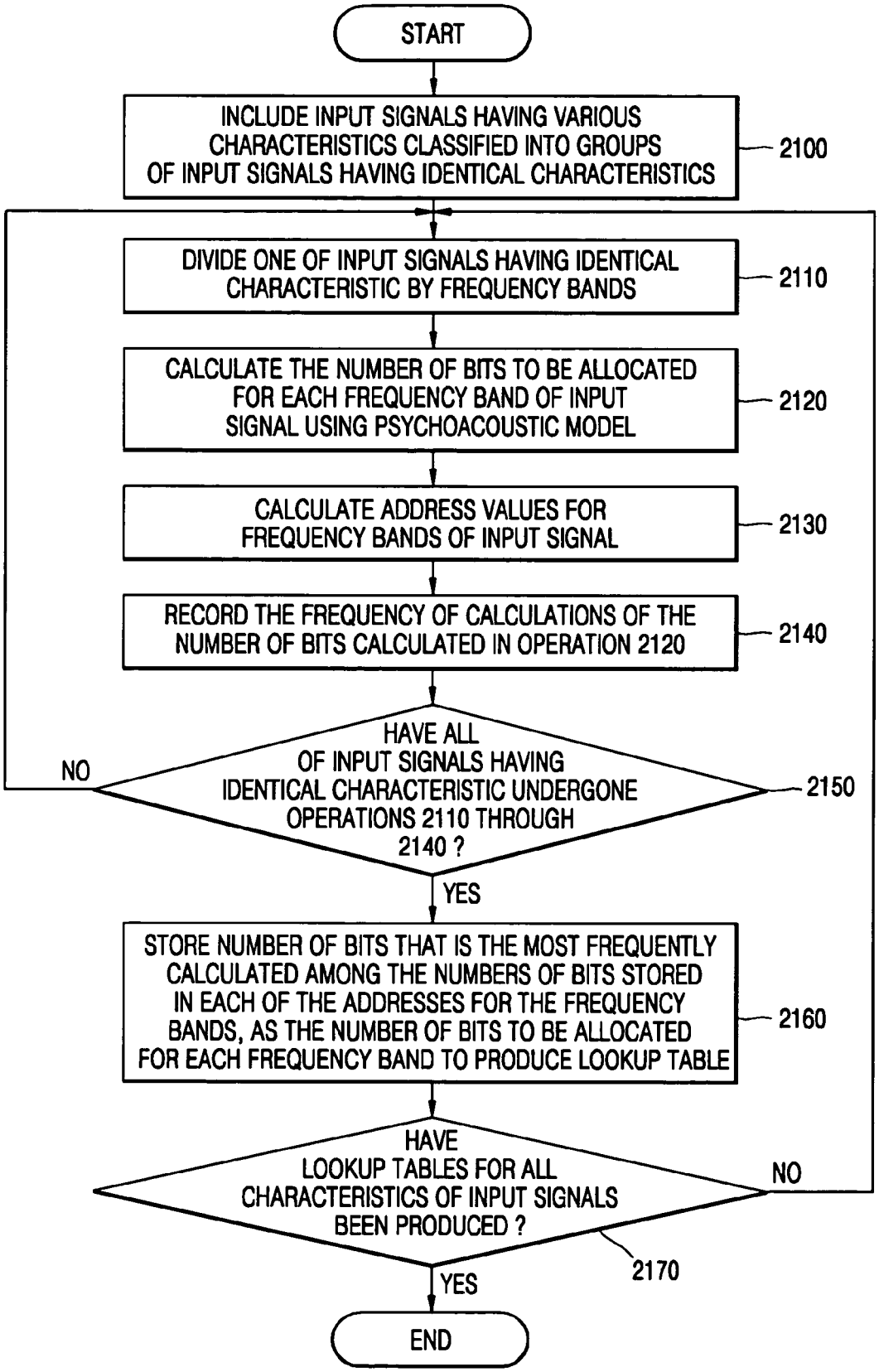
FIG. 21 is a flowchart illustrating a method of producing a plurality of lookup tables, according to an embodiment of the present invention.

FIG. 21 is a flowchart illustrating a method of producing the plurality of lookup tables, according to an embodiment of the present invention. As illustrated in FIG. 21, a predetermined number of input signals having various characteristics are classified into groups of input signals having identical characteristics, in operation 2100. The characteristics of the input are the same as in the above description of the lookup tables.

In operation 2110, one of the characteristics of the input signals is selected, and one of input signals having the selected characteristic is divided by frequency bands. In operation 2120, the number of bits to be allocated for each frequency band of the input signal is calculated using a psychoacoustic model. The calculation of the number of bits to be allocated for each frequency band in operation 2120 is the same as an operation of the psychoacoustic model 110 of FIG. 1, so it will not be described herein.

In operation 2130, address values for the frequency bands of the input signal are calculated. The address values are set to values indicating characteristics of the frequency bands of the input signal. The address values are the same as in the above description of the lookup tables.

In operation 2140, the numbers of bits to be allocated to the frequency bands calculated in operation 2120 are stored in addresses corresponding to the address values of the frequency bands calculated in operation 2130, and the frequency of calculations of the stored number of bits to be allocated for each frequency band is recorded.

In operation 2150, it is determined whether all of the input signals having the selected characteristic have undergone operations 2110 through 2140. If all of the input signals having the selected characteristic have not yet undergone operations 2110 through 2140, operations 2110 through 2140 are repeated.

On the other hand, if all of the input signals having the selected characteristic have undergone operations 2110 through 2140, a number of bits to be allocated that is the most frequently calculated among the numbers of bits stored in the addresses for each frequency band is stored as the number of bits to be allocated for each frequency band to produce a lookup table, in operation 2160. After operation 2160, addresses which record 0 as the number of bits allocated may be excluded from the produced lookup table. Also, when identical numbers of allocated bits are recorded in consecutive addresses, only addresses where different numbers of allocated bits are recorded may be stored in a lookup table to produce a small-sized lookup table.

In operation 2170, it is determined whether lookup tables for all characteristics of the input signals have been produced. If all of the lookup tables have not yet been produced, operations 2110 through 2160 are repeated until all of the lookup tables are produced.

Figure 22:
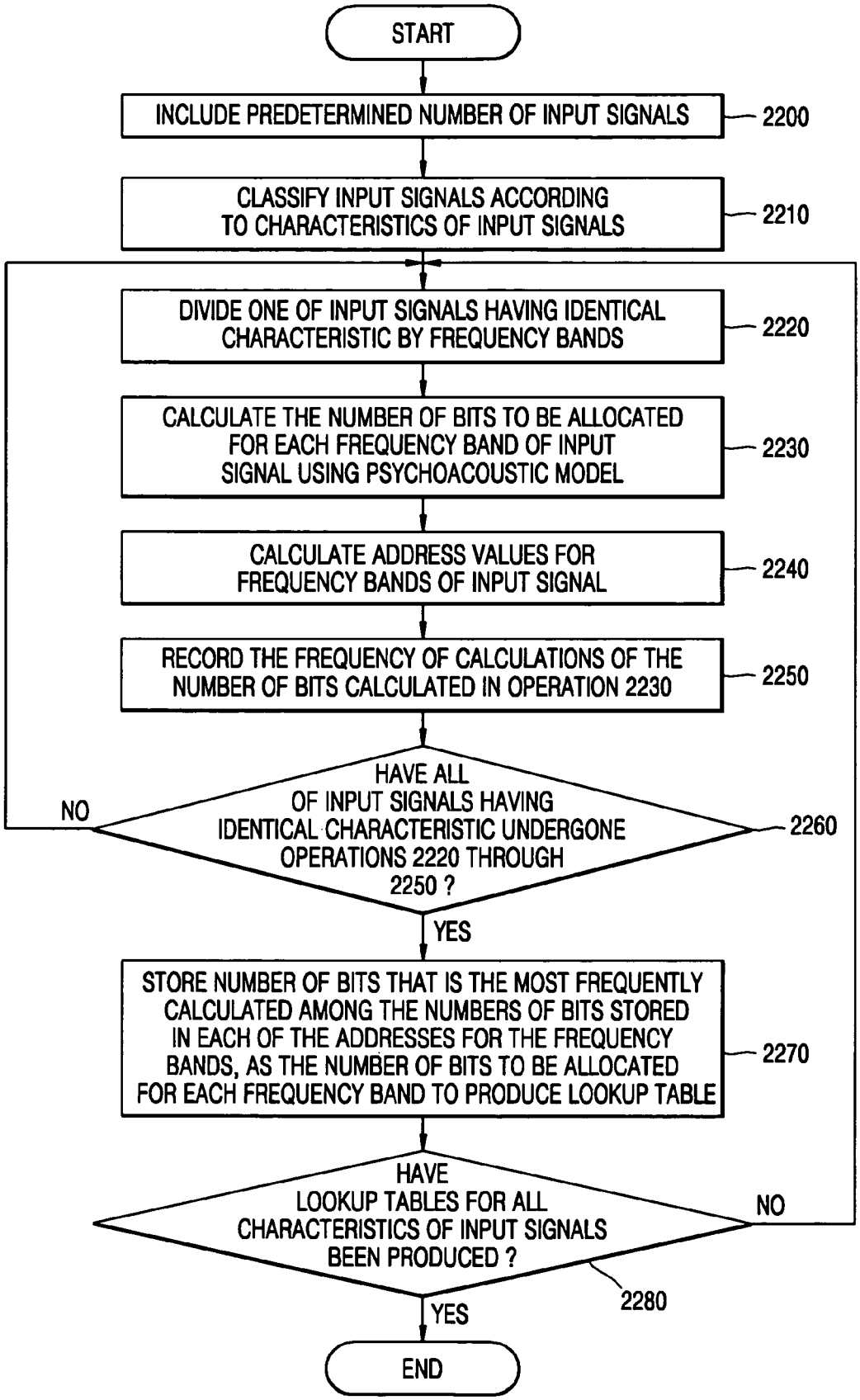
FIG. 22 is a flowchart illustrating a method of producing a plurality of lookup tables, according to another embodiment of the present invention.

FIG. 22 is a flowchart illustrating a method of producing a plurality of lookup tables, according to another embodiment of the present invention. Referring to FIG. 22, a predetermined number of input signals having various characteristics are included in operation 2200. The input signals are classified according to the characteristics of the input signals, in operation 2210. The characteristics of the input signals are the same as in the description of the lookup tables. Operations 2220 through 2280 of FIG. 22 are the same as operation 2110 through 2170 of FIG. 21.

FIG. 23 is a table illustrating a method of setting addresses used in a lookup table, according to an embodiment of the present invention. Referring to FIG. 23, a larger value between an occupancy rate of a squared scale factor of each frequency band and an occupancy rate of a mean power of each frequency band is used as each address of a lookup table. The occupancy rates used as the addresses of the lookup table range between 0 and 1. The occupancy rates between 0 and 1 are divided into 127 addresses.

FIG. 24 is a table illustrating a method of producing a lookup table, according to an embodiment of the present invention. The method of FIG. 24 is operation 2160 of FIG. 21 or operation 2270 of FIG. 22, in which a lookup table is produced using the frequency of calculations of the stored number of bits allocated for each frequency band. Referring to FIG. 24, the number of bits allocated for each address for each frequency band is stored to produce a lookup table. In address 5 of the lookup table, the number of allocated bits, 8, which was calculated the most frequently among the stored numbers of allocated bits for the address 5, is stored as a final number of bits to be allocated. In address 30 of the lookup table, the number of allocated bits, 7, which was calculated the most frequently among the stored numbers of allocated bits for the address 30, is stored as a final number of bits to be allocated. In address 61 of the lookup table, the number of allocated bits, 0, which was calculated the most frequently among the stored numbers of allocated bits for the address 61, is stored as a final number of bits to be allocated. To reduce a volume of the lookup table, addresses which record 0 as the number of bits allocated may be excluded from a lookup table to be produced. Also, when identical numbers of allocated bits are recorded in consecutive addresses, only addresses that record different numbers of allocated bits may be stored in the lookup table.

Decoding apparatuses corresponding to the encoding apparatuses according to the four embodiments of the present invention will now be described.

Figure 25:
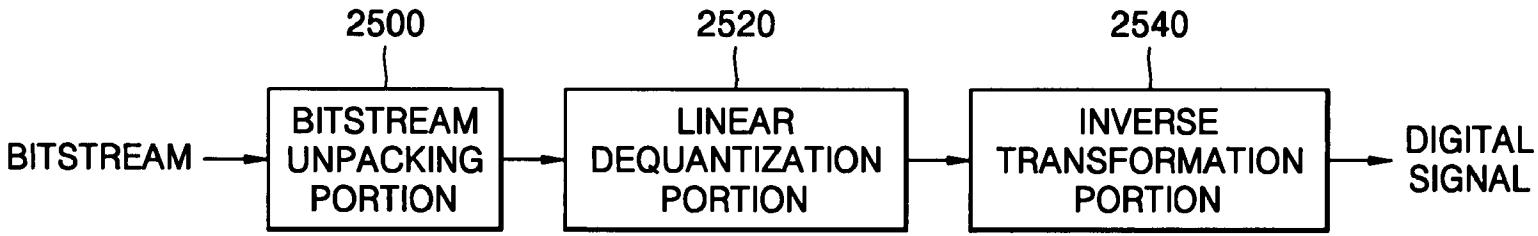
FIG. 25 is a block diagram of a digital signal decoding apparatus corresponding to a digital signal encoding apparatus in which linear quantization by sections is performed using a plurality of lookup tables, according to an embodiment of the present invention.

FIG. 25 is a block diagram of a digital signal decoding apparatus corresponding to the digital signal encoding apparatus in which linear quantization by sections is performed using a plurality of lookup tables. This digital signal decoding apparatus is comprised of a bitstream unpacking portion 2500, a linear dequantization portion 2520, and an inverse transformation portion 2540.

The bitstream unpacking portion 2500 extracts linearly quantized data and side information from a bitstream into which a digital signal is encoded. For example, when the bitstream is an audio signal bitstream, quantized sample data and side information are extracted.

The linear dequantization portion 2520 dequantizes the linearly quantized data on a section-by-section basis using the side information extracted by the bitstream unpacking portion 2500. The section corresponds to a section set upon quantization for encoding. If the section for quantization is set based on an input axis of the graph of FIG. 11 upon encoding, the section for dequantization is set based on an output axis of the graph of FIG. 11 upon decoding.

The inverse transformation portion 2540 inversely transforms the dequantized data obtained by the linear dequantization portion 2520 into the digital signal, preferably, PCM data. The inverse transformation is an inverse transformation of the transformation used upon encoding. When a band-split filter is used as a sub-band filter upon transformation, the inverse transformation portion 2540 uses a band-synthesis filter.

Figure 26:
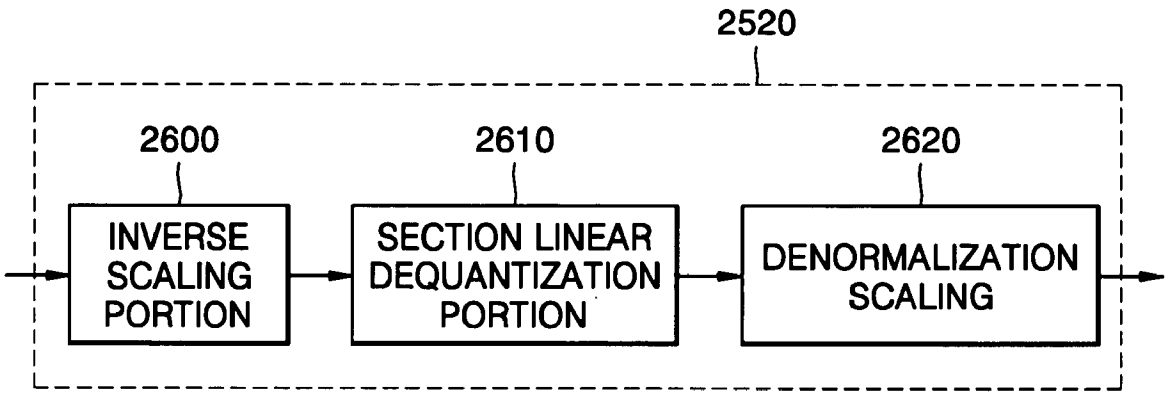
FIG. 26 is a block diagram of a detailed structure of a linear dequantization portion of FIG. 25.

FIG. 26 is a block diagram of a detailed structure of the linear dequantization portion 2520. The linear dequantization portion 2520 is comprised of an inverse scaling portion 2600, a section linear dequantization portion 2610, and a denormalization portion 2620.

The inverse scaling portion 2600 inverse scales the sample data that are linearly quantized in sections, using bit allocation information included in the side information extracted by the bitstream unpacking portion 2500. The inverse scaling corresponds to the scaling used for quantization. For example, if 4 bits are allocated for encoding and the sample data was multiplied by 15, then the sample data is divided by 15 for decoding.

The section linear dequantization portion 2610 linear dequantizes the inverse-scaled data for each section. The denormalization portion 2620 denormalizes the data dequantized by the section linear dequantization portion 2610 using an inverse scale factor that corresponds to the scaling factor used for quantization.

Figure 27:
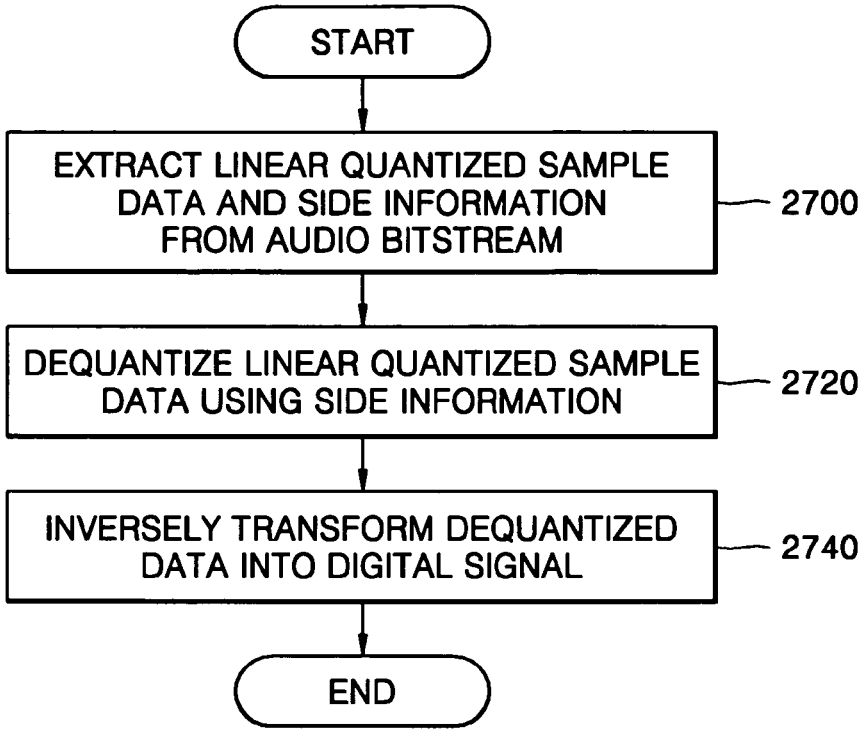
FIG. 27 is a flowchart illustrating a digital signal decoding method corresponding to a digital signal encoding method in which linear quantization by sections is performed using a plurality of lookup tables, according to an embodiment of the present invention.

FIG. 27 is a flowchart illustrating a digital signal decoding method corresponding to the digital signal encoding method in which linear quantization by sections is performed using a plurality of lookup tables, according to an embodiment of the present invention. Referring to FIGS. 25 and 27, first, when a bit stream of a digital signal, which may be an audio digital signal, is input to the bitstream unpacking portion 2500, quantized sample data and side information are extracted from the audio bitstream, in operation 2700.

In operation 2720, the sample data that is linearly quantized by sections, is dequantized by sections using the side information by the linear dequantization portion 2520. The sections for dequantization correspond to the sections divided for the linear quantization (e.g., if the sections for quantization were divided with respect to the input-axis illustrated in FIG. 11 for encoding, then the sections are divided with respect to the output-axis for decoding). Afterwards, the dequantized data is inversely transformed into the digital signal, preferably PCM data, in operation 2740. This inverse transformation is the inverse of the transformation used for encoding.

Figure 28:
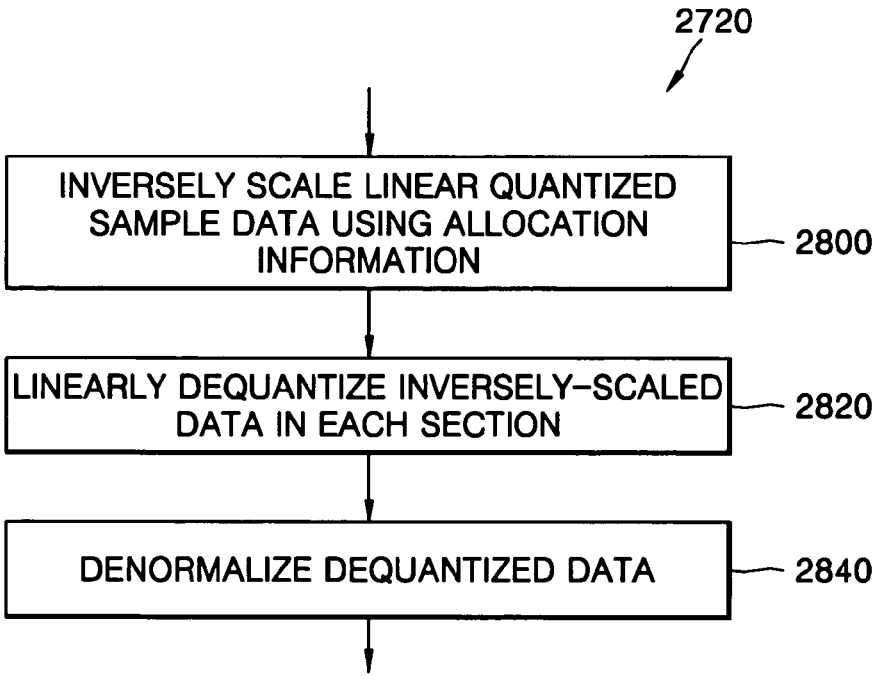
FIG. 28 is a flowchart illustrating an operation of dequantizing sample data.

FIG. 28 is a flowchart illustrating operation 2720 of dequantizing the sample data. Referring to FIGS. 25 and 28, the sample data that are linearly quantized by sections is scaled inversely to the scaling used for quantization by the inverse scaling portion 2600 using the bit allocation information, in operation 2800. Afterwards, the inversely scaled data is linearly dequantized in each section in the section linear dequantization portion 2610, in operation 2820. The dequantized data is then denormalized by the denormalization portion 2620 by using an inverse scale factor that corresponds to the scaling factor used for quantization, in operation 2840.

Figure 29:
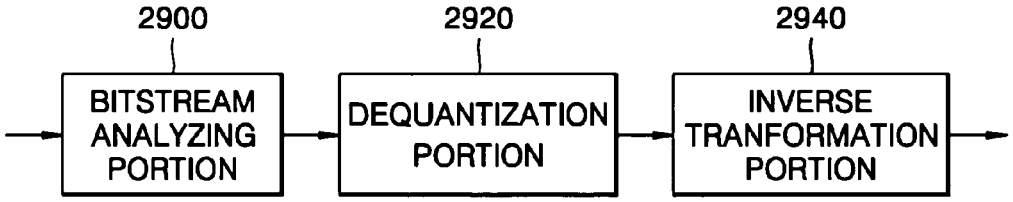
FIG. 29 is a block diagram of a digital signal decoding apparatus corresponding to a digital signal encoding apparatus in which a bit stream including frame length information is produced using a plurality of lookup tables, according to another embodiment of the present invention.

FIG. 29 is a block diagram of a digital signal decoding apparatus corresponding to the digital signal encoding apparatus in which a bit stream including frame length information is produced using a plurality of lookup tables, according to another embodiment of the present invention. This digital signal decoding apparatus is comprised of a bitstream analyzing portion 2900, a dequantization portion 2920, and an inverse transformation portion 2940. The bitstream analyzing portion 2900 extracts side information, quantized data, and frame length information from a bitstream of a digital signal. If the bitstream is an audio signal bitstream, quantized sample data, side information, and frame length information are extracted. The bitstream analyzing portion 2900 also extracts sync information if the bitstream further includes sync information.

Figure 30:
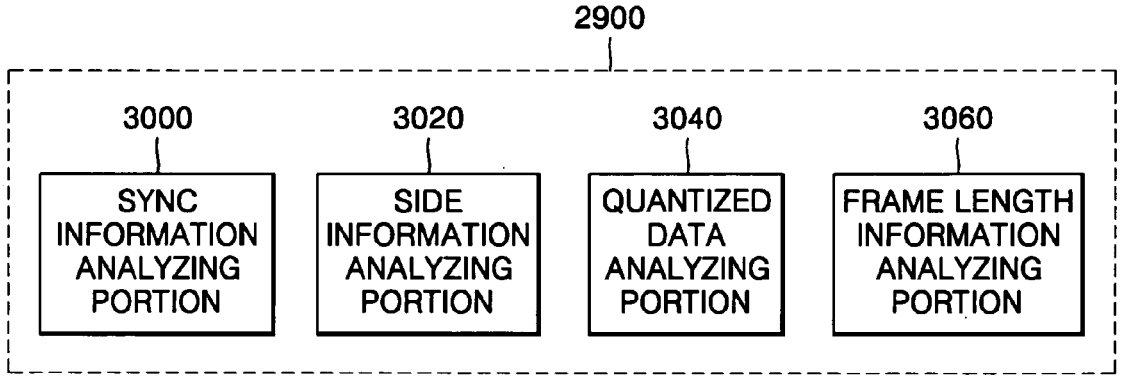
FIG. 30 is a block diagram of a bit stream analyzing portion of FIG. 29.

FIG. 30 is a block diagram of the bit stream analyzing portion 2900, which is comprised of a synch information analyzing portion 3000, a side information analyzing portion 3020, a quantized data analyzing portion 3040, and a frame length information analyzing portion 3060.

The synch information analyzing portion 3000 extracts the sync information from the bitstream of the digital signal. The side information analyzing portion 3020 extracts the side information from the bitstream. The quantized data analyzing portion 3040 extracts the quantized data from the bitstream. The frame length information analyzing portion 3060 extracts the frame length information from the bitstream.

Referring back to FIG. 29, the dequantization portion 2920 dequantizes the extracted quantized data using the side information extracted by the bitstream analyzing portion 2900.

The inverse transformation portion 2940 transforms the data dequantized by the dequantization portion 2920 into the digital signal, preferably, PCM data, using an inverse transformation of a transformation used for encoding. If a band-split filter was used as a sub-band filter upon transformation, a band-synthesis filter is used as the inverse transformation portion 2940.

Figure 31:
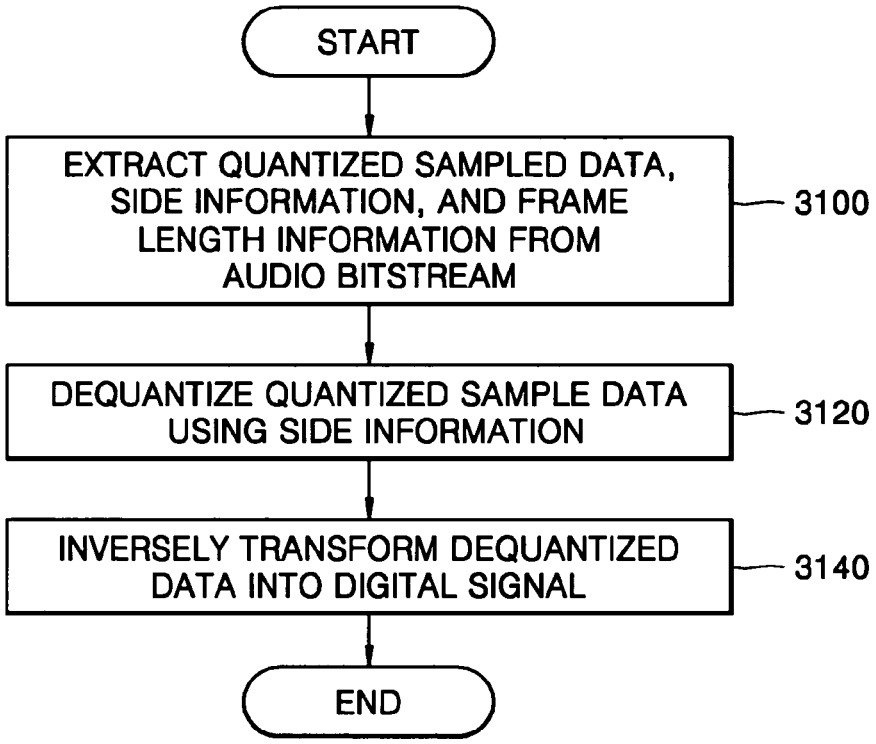
FIG. 31 is a flowchart illustrating a digital signal decoding method corresponding to a digital signal encoding method in which a bit stream including frame length information is produced using a plurality of lookup tables, according to another embodiment of the present invention.

FIG. 31 is a flowchart illustrating a digital signal decoding method corresponding to the digital signal encoding method in which a bit stream including frame length information is produced using a plurality of lookup tables, according to another embodiment of the present invention.

Referring to FIGS. 29 and 31, first, when a bitstream, which may be an audio bitstream, of a digital signal is input to the bitstream analyzing portion 2900, quantized sampled data, side information, and frame length information are extracted from the audio bitstream, in operation 3100. If sync information is included in the bitstream, it is also extracted from the bitstream.

In operation 3120, the dequantization portion 2920 dequantizes the quantized sample data using the side information. Thereafter, in operation 3140, the dequantized data is transformed inversely to the transformation used for encoding to produce the digital signal, which may be PCM data.

Figure 32:
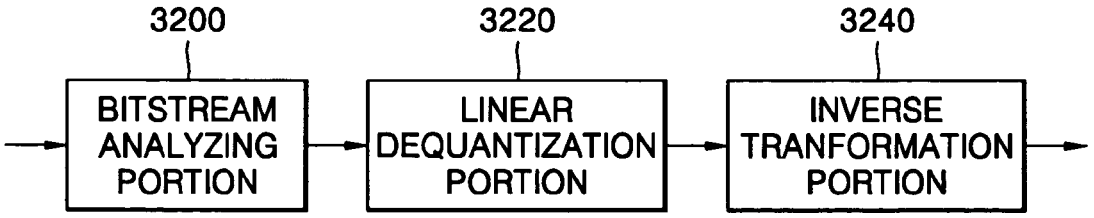
FIG. 32 is a block diagram of a digital signal decoding apparatus corresponding to a digital signal encoding apparatus in which a bit stream including frame length information is produced using a plurality of lookup tables and linear quantization by sections and to a digital signal encoding apparatus in which a bit stream including frame length information is produced using linear quantization by sections, according to another embodiment of the present invention.

FIG. 32 is a block diagram of a digital signal decoding apparatus corresponding to a digital signal encoding apparatus in which a bit stream including frame length information is produced using a plurality of lookup tables and linear quantization by sections and to a digital signal encoding apparatus in which a bit stream including frame length information is produced using linear quantization by sections, according to another embodiment of the present invention. This digital signal decoding apparatus is comprised of a bitstream analyzing portion 3200, a linear dequantization portion 3220, and an inverse transformation portion 3240.

The bitstream analyzing portion 3200 extracts side information, quantized data, and frame length information from a bitstream of a digital signal. If the bitstream is an audio signal bitstream, quantized sample data, side information, and frame length information are extracted. The bitstream analyzing portion 3200 also extracts sync information if the bitstream further includes the sync information.

The bit stream analyzing portion 3200 has the same structure as that of the bitstream analyzing portion 2900 illustrated in FIG. 30. Accordingly, the bit stream analyzing portion 3200 is comprised of the synch information analyzing portion 3000, the side information analyzing portion 3020, the quantized data analyzing portion 3040, and the frame length information analyzing portion 3060. The synch information analyzing portion 3000 extracts the sync information from the bitstream of the digital signal. The side information analyzing portion 3020 extracts the side information from the bitstream. The quantized data analyzing portion 3040 extracts the quantized data from the bitstream. The frame length information analyzing portion 3060 extracts the frame length information from the bitstream.

The linear dequantization portion 3220 dequantizes the data which is linearly quantized by sections, by sections corresponding to the sections divided for the linear quantization, using the side information extracted by the bitstream analyzing portion 3200. If the sections for the linear quantization are set based on the input axis of the graph of FIG. 11 upon encoding, the sections for the linear dequantization are set based on the output axis of the graph of FIG. 11 upon decoding.

The linear dequantization portion 3220 has the same structure as the structure of the linear dequantization portion 2520 illustrated in FIG. 26. Accordingly, the linear dequantization portion 3220 is comprised of the inverse scaling portion 2600, the section linear dequantization portion 2610, and the denormalization portion 2620. The inverse scaling portion 2600 inversely scales the sample data that are linearly quantized in sections, using bit allocation information included in the side information extracted by the bitstream unpacking portion 2500. The inverse scaling corresponds to the scaling used for quantization. For example, if 4 bits are allocated for encoding and the sample data was multiplied by 15, then the sample data is divided by 15 for decoding.

The section linear dequantization portion 2610 linear dequantizes the inverse-scaled data for each section. The denormalization portion 2620 denormalizes the data dequantized by the section linear dequantization portion 2610 using an inverse scale factor that corresponds to the scaling factor used for quantization.

Referring back to FIG. 32, the inverse transformation portion 3240 transforms the data dequantized by the linear dequantization portion 3220 into the digital signal, preferably, PCM data, using an inverse transformation of a transformation used for encoding. If a band-split filter was used as a sub-band filter upon transformation, a band-synthesis filter is used as the inverse transformation portion 3240.

Figure 33:
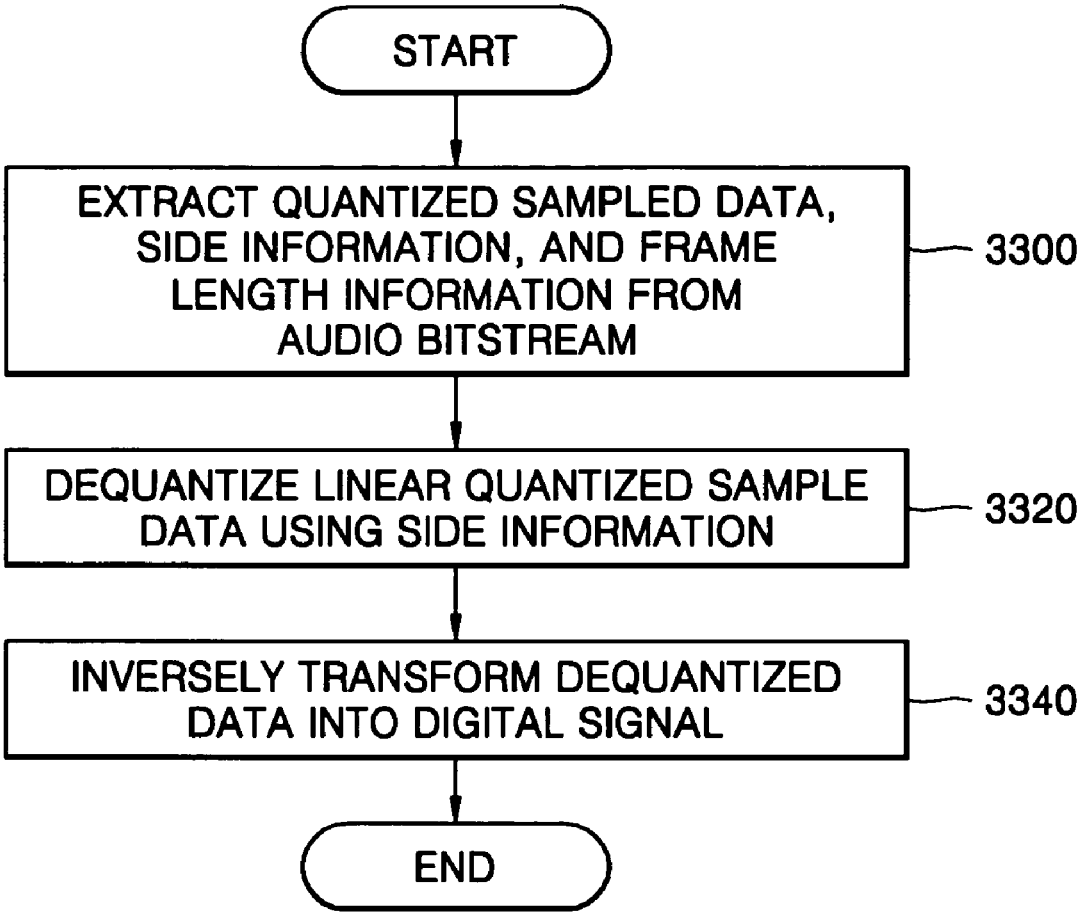
FIG. 33 is a flowchart illustrating a digital signal decoding method corresponding to a digital signal encoding method in which a bit stream including frame length information is produced using a plurality of lookup tables and linear quantization by sections and to a digital signal encoding method in which a bit stream including frame length information is produced using linear quantization by sections, according to another embodiment of the present invention.

FIG. 33 is a flowchart illustrating a digital signal decoding method corresponding to the digital signal encoding method in which a bit stream including frame length information is produced using a plurality of lookup tables and linear quantization by sections and to a digital signal encoding method in which a bit stream including frame length information is produced using linear quantization by sections, according to another embodiment of the present invention.

Referring to FIGS. 32 and 33, first, when a bitstream, which may be an audio bitstream, of a digital signal is input to the bitstream analyzing portion 3200, side information, quantized sampled data, and frame length information are extracted from the audio bitstream by the side information analyzing portion 3020, the quantized data analyzing portion 3040, and the frame length information analyzing portion 3060 of the bitstream analyzing portion 3200, respectively, in operation 3300. If sync information is included in the bitstream, it is also extracted from the bitstream by the sync information analyzing portion 3000 of the bitstream analyzing portion 3200.

In operation 3320, the sample data that is linearly quantized by sections is dequantized by sections using the side information by the linear dequantization portion 3220. The sections for dequantization correspond to the sections divided for the linear quantization (e.g., if the sections for quantization were divided with respect to the input-axis illustrated in FIG. 11 for encoding, then the sections are divided with respect to the output-axis for decoding). Afterwards, the dequantized data is inversely transformed into the digital signal, preferably PCM data, in operation 3340. This inverse transformation is the inverse of the transformation used for encoding.

Operation 3320 of FIG. 33 is the same as operation 2720, so it is comprised of operations 2800, 2820, and 2840 illustrated in FIG. 28. Referring to FIG. 28, first, the sample data that are linearly quantized by sections is scaled inversely to the scaling used for quantization by the inverse scaling portion 2600 using the bit allocation information, in operation 2800. Afterwards, the inversely scaled data is linearly dequantized in each section in the section linear dequantization portion 2610, in operation 2820. The dequantized data is then denormalized by the denormalization portion 2620 by using an inverse scale factor that corresponds to the scaling factor used for quantization, in operation 2840.

According to embodiments of the present invention as described above, a digital signal is encoded using a plurality of lookup tables. In other words, the numbers of bits allocated for frequency bands are extracted from an optimal lookup table selected from the lookup tables according to characteristics of an input signal. Thus, control of the amount of bits adequate for the characteristics of the input signal is possible. Also, an additional calculation can be saved by using occupancy rates of the frequency bands, which are the same as addresses of each lookup table, as a characteristic of the input signal.

In addition, by encoding a digital signal using linear quantization by sections, the complexity of a non-linear quantizer can be significantly reduced while improving a sound quality compared to a general linear quantizer in consideration of a distribution of audio data.

Furthermore, when frame length information is included in the end of the frame comprised of frames, a point of effective audio data to be reproduced upon generation of an impact can be accurately searched for. Therefore, a period of time when reproduction of audio data is protected from the impact can be extended due to the encoding according to an embodiment of the present invention, and a clean sound without interruptions can be provided to users within the protection-from-impact period of time regardless of an encoding rate.

Embodiments of the present invention can be embodied as computer (including all devices that have information processing functions) readable codes in a computer storage such as a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, and optical data storage devices.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of encoding a digital signal, comprising:

transforming a digital input signal into samples to remove redundant information among signals;

selecting a lookup table corresponding to a characteristic of the digital input signal among a plurality of lookup tables that indicate different numbers of bits allocated for each of a plurality of quantization units depending on different characteristics of input signals and acquiring the number of bits allocated for each quantization unit from the selected lookup table;

dividing a distribution of samples within each quantization unit into a predetermined number of sections and linearly quantizing the samples using the allocated number of bits on a section-by-section basis; and producing a bitstream from the linearly quantized samples and predetermined side information.

2. The method of claim 1, wherein the transforming of the digital signal is performed using one of a modified discrete cosine transform, a fast Fourier transform, a discrete cosine transform, and a sub-band filtering.

3. The method of claim 1, wherein the side information includes at least a scale factor of each quantization unit and a number of bits to be allocated for each quantization unit.

4. The method of claim 1, wherein the characteristic of the digital input signal in the selecting of the lookup table and acquiring of the number of bits allocated comprises the number of frequency bands including samples at occupancy rates no less than or no greater than a predetermined reference value among frequency bands of the digital input signal.

5. The method of claim 4, wherein the occupancy rates comprise one of a larger occupancy rate between an occupancy rate of a squared scale factor of a frequency band and an occupancy rate of a mean power of samples within the frequency band and a larger occupancy rate between an occupancy rate of a scale factor of a frequency band and an occupancy rate of a mean value of samples within the frequency band.

6. The method of claim 1, wherein each of the lookup tables includes at least one address for each quantization unit and a predetermined number of bits for each quantization unit.

7. The method of claim 6, wherein the addresses of each of the lookup tables comprise one of scale factors and squared scale factors of the frequency bands.

8. The method of claim 6, wherein the addresses of each of the lookup tables comprise one of mean values and mean powers of samples within the frequency bands.

9. The method of claim 6, wherein the addresses of each of the lookup tables comprise one of larger occupancy rates between occupancy rates of scale factors of the frequency bands and occupancy rates of mean values of samples within the frequency bands and larger occupancy rates between occupancy rates of squared scale factors of the frequency bands and occupancy rates of mean powers of samples within the frequency bands.

10. The method of claim 1, after the selecting of the lookup table and acquiring of the number of bits allocated, further comprising comparing the number of bits allocated for the entire digital input signal with the number of bits required for the entire digital input signal and adjusting the number of bits allocated for the entire input signal according to a result of the comparison.

11. The method of claim 1, wherein the dividing of the distribution of the samples and linearly quantizing of the samples comprises:

normalizing the samples within each quantization unit using a predetermined scale factor;

dividing a range of normalized sample values into a predetermined number of sections and transforming the normalized sample values by applying a linear function set for each section;

scaling the transformed values using the number of bits allocated for each quantization unit; and rounding the scaled values to a nearest whole number to obtain quantized values.

12. The method of claim 11, wherein the scale factor is an integer determined by a predetermined function of a value no less than a maximum absolute value among sample values within each quantizing unit.

13. The method of claim 11, wherein the linear functions comprise a plurality of independent linear functions for the sections.

14. The method of claim 13, wherein the dividing of the range of the normalized sample values and transforming of the normalized sample values comprises:

dividing the range of the normalized sample values into two sections; and transforming the normalized data by applying linear functions set for the two sections to the normalized data, wherein the linear functions are expressed as $$y = \frac{ax}{(a-2b)}$$

and $$y = \frac{x}{(1+2b)} + \frac{2b}{(1+2b)},$$

wherein a denotes the range of normalized values, and b denotes section displacement from the center of a.

15. The method of claim 11, wherein the linear quantization by sections satisfies continuity.

16. A method of encoding a digital signal, comprising:

transforming a digital input signal into samples to remove redundant information among signals;

selecting a lookup table corresponding to a characteristic of the digital input signal among a plurality of lookup tables that indicate different numbers of bits allocated for each of a plurality of quantization units depending on different characteristics of input signals and acquiring the number of bits allocated for each quantization unit from the selected lookup table;

quantizing the samples using the number of bits allocated for each quantization unit; and producing a bitstream comprised of frames from the quantized samples and predetermined side information so that information about a frame length is stored in the end of the frame.

17. The method of claim 16, wherein the bitstream comprised of frames further includes sync information indicating a beginning of each frame, which is located in a head portion of each frame.

18. The method of claim 17, wherein the bitstream comprised of frames is a result of encoding at a fixed bit rate or a variable bit rate.

19. The method of claim 16, wherein the bitstream comprised of frames is a result of encoding at a fixed bit rate or a variable bit rate.

20. A method of encoding a digital signal, comprising:

transforming a digital input signal into samples to remove redundant information among signals;

calculating a number of bits to be allocated for each of a plurality of quantization units;

dividing a distribution of samples within each quantization unit into a predetermined number of sections and linearly quantizing the samples using the allocated bits on a section-by-section basis; and producing a bitstream comprised of frames from the quantized samples and predetermined side information so that information about a frame length is stored in the end of the frame.

21. A method of encoding a digital signal, comprising:

transforming a digital input signal into samples to remove redundant information among signals;

selecting a lookup table corresponding to a characteristic of the digital input signal among a plurality of lookup tables that indicate different numbers of bits allocated for each of a plurality of quantization units depending on different characteristics of input signals and acquiring the number of bits allocated for each quantization unit from the selected lookup table;

dividing a distribution of samples within each quantization unit into a predetermined number of sections and linearly quantizing the samples using the allocated number of bits on a section-by-section basis; and producing a bitstream comprised of frames from the quantized samples and predetermined side information so that information about a frame length is stored in the end of the frame.

22. The method of claim 21, wherein the side information includes at least a scale factor of each quantization unit and a number of bits to be allocated for each quantization unit.

23. The method of claim 21, wherein the characteristic of the digital input signal in the selecting of the lookup table and acquiring of the number of bits allocated is the number of frequency bands including samples at occupancy rates no less than or no greater than a predetermined reference value among frequency bands of the digital input signal.

24. The method of claim 23, wherein the occupancy rate comprises one of a larger occupancy rate between an occupancy rate of a squared scale factor of a frequency band and an occupancy rate of a mean power of samples within the frequency band and a larger occupancy rate between an occupancy rate of a scale factor of a frequency band and an occupancy rate of a mean value of samples within the frequency band.

25. The method of claim 21, wherein each of the lookup tables includes at least one address for each quantization unit and a predetermined number of bits for each quantization unit.

26. The method of claim 25, wherein the addresses of each of the lookup tables comprise one of scale factors and squared scale factors of the frequency bands.

27. The method of claim 25, wherein the addresses of each of the lookup tables comprise one of mean values and mean powers of samples within the frequency bands.

28. The method of claim 25, wherein the addresses of each of the lookup tables comprise one of larger occupancy rates between occupancy rates of scale factors of the frequency bands and occupancy rates of mean values of samples within the frequency bands and larger occupancy rates between occupancy rates of squared scale factors of the frequency bands and occupancy rates of mean powers of samples within the frequency bands.

29. The method of claim 25, after the selecting of the lookup table and acquiring of the number of bits allocated, further comprising comparing the number of bits allocated for the entire digital input signal with the number of bits required for the entire digital input signal and adjusting the number of bits allocated for the entire digital input signal according to a result of the comparison.

30. The method of claim 21, wherein the dividing of the distribution of the samples and linearly quantizing of the samples comprises:

normalizing the samples within each quantization unit using a predetermined scale factor;

dividing a range of normalized sample values into a predetermined number of sections and transforming the normalized sample values by applying a linear function set for each section scaling the transformed values using the number of bits allocated for each quantization unit; and rounding the scaled values to a nearest whole number to obtain quantized values.

31. The method of claim 30, wherein the scale factor is an integer determined by a predetermined function of a value no less than a maximum absolute value among sample values within each quantizing unit.

32. The method of claim 30, wherein the linear functions comprise a plurality of independent linear functions for the sections.

33. The method of claim 32, wherein the dividing of the range of the normalized sample values and transforming of the normalized sample values comprises:

dividing the range of the normalized sample values into two sections; and transforming the normalized data by applying linear functions set for the two sections to the normalized data, wherein the linear functions are expressed as $$y = \frac{ax}{(a-2b)}$$

and $$y = \frac{x}{(1+2b)} + \frac{2b}{(1+2b)},$$

wherein a denotes the range of normalized values, and b denotes section displacement from the center of a.

34. The method of claim 30, wherein the linear quantization by sections satisfies continuity.

35. The method of claim 21, wherein the bitstream comprised of frames further includes sync information indicating a beginning of each frame, which is located in a head portion of each frame.

36. The method of claim 35, wherein the bitstream comprised of frames is a result of encoding at a fixed bit rate or a variable bit rate.

37. An apparatus for encoding a digital signal, comprising:

a data transformation portion transforming a digital input signal into samples to remove redundant information among signals;

a plurality of lookup tables indicating different numbers of bits allocated for each of a plurality of quantization units depending on different characteristics of input signals;

a lookup table selection portion selecting a lookup table corresponding to a characteristic of the digital input signal among the lookup tables;

a bit allocation portion extracting the numbers of bits allocated for the quantization units from addresses for the quantization units in the selected lookup table;

a linear quantization portion dividing a distribution of samples within each quantization unit into a predetermined number of sections and linearly quantizing the samples using the allocated number of bits on a section-by-section basis; and a bit packing portion producing a bitstream from the linearly quantized samples and predetermined side information.

38. The apparatus of claim 37, wherein the characteristic of the digital input signal in the selecting of the lookup table and acquiring of the number of bits allocated comprises the number of frequency bands including samples at occupancy rates no less than or no greater than a predetermined reference value among frequency bands of the digital input signal.

39. The apparatus of claim 38, wherein the occupancy rate comprises one of a larger occupancy rate between an occupancy rate of a squared scale factor of a frequency band and an occupancy rate of a mean power of samples within the frequency band and a larger occupancy rate between an occupancy rate of a scale factor of a frequency band and an occupancy rate of a mean value of samples within the frequency band.

40. The apparatus of claim 37, wherein the addresses of each of the lookup tables comprise one of scale factors and squared scale factors of the frequency bands.

41. The apparatus of claim 37, wherein the addresses of each of the lookup tables comprise one of mean values and mean powers of samples within the frequency bands.

42. The apparatus of claim 37, wherein the addresses of each of the lookup tables comprise one of large occupancy rates between occupancy rates of scale factors of the frequency bands and occupancy rates of mean values of samples within the frequency bands and larger occupancy rates between occupancy rates of squared scale factors of the frequency bands and occupancy rates of mean powers of samples within the frequency bands.

43. The apparatus of claim 37, further comprising a number-of-bits adjusting portion comparing the number of bits allocated for the entire digital input signal by the bit allocation portion with the number of bits required for the entire digital input signal and adjusting the number of bits allocated for the entire digital input signal according to a result of the comparison.

44. The apparatus of claim 37, wherein the linear quantization portion comprises:

a data normalization portion normalizing the samples obtained by the data transformation portion using a predetermined scale factor;

a section quantization portion dividing a range of normalized sample values into a predetermined number of sections and applying a linear function set for each section to the normalized sample values;

a scaling portion scaling the values obtained by the section quantization portion using the number of bits allocated for each quantization unit by the bit allocation portion; and a rounding portion rounding the scaled values to a nearest whole number using the number of allocated bits to obtain quantized values.

45. The apparatus of claim 44, wherein the linear functions comprise a plurality of independent linear functions for the sections.

46. The apparatus of claim 37, wherein the bitstream comprised of frames further includes sync information indicating a beginning of each frame, which is located in a head portion of each frame.

47. An apparatus for encoding a digital signal, comprising:

a data transformation portion transforming a digital input signal into samples to remove redundant information among signals;

a plurality of lookup tables indicating different numbers of bits allocated for each of a plurality of quantization units depending on different characteristics of input signals;

a lookup table selection portion selecting a lookup table corresponding to a characteristic of the digital input signal among the lookup tables;

a bit allocation portion extracting the numbers of bits allocated for the quantization units from addresses for the quantization units in the selected lookup table;

a quantization portion quantizing the samples using the number of bits allocated for each quantization unit by the bit allocation portion; and a bitstream producing portion producing a bitstream comprised of frames from the linearly quantized samples and predetermined side information so that information about a frame length is included in the end of the frame.

48. The apparatus of claim 47, wherein the bitstream comprised of frames further includes sync information indicating a beginning of each frame, which is located in a head portion of each frame.

49. An apparatus for encoding a digital signal, comprising:

a data transformation portion transforming a digital input signal into samples to remove redundant information among signals;

a number-of-bits-to-be-allocated calculating portion calculating the number of bits to be allocated for each of a plurality of quantization units;

a linear quantization portion dividing a distribution of samples within each of a plurality of quantization unit into a predetermined number of sections and linearly quantizing the samples using the allocated number of bits on a section-by-section basis; and a bitstream producing portion producing a bitstream comprised of frames from the linearly quantized samples and predetermined side information so that information about a frame length is included in the end of the frame.

50. An apparatus for encoding a digital signal, comprising:

a data transformation portion transforming a digital input signal into samples to remove redundant information among signals;

a plurality of lookup tables indicating different numbers of bits allocated for each of a plurality of quantization units depending on different characteristics of input signals;

a lookup table selection portion selecting a lookup table corresponding to a characteristic of the digital input signal among the lookup tables;

a bit allocation portion extracting the numbers of bits allocated for the quantization units from addresses for the quantization units in the selected lookup table;

a linear quantization portion dividing a distribution of samples within each quantization unit into a predetermined number of sections and linearly quantizing the samples using the allocated number of bits on a section-by-section basis; and a bitstream producing portion producing a bitstream comprised of frames from the linearly quantized samples and predetermined side information so that information about a frame length is included in the end of the frame.

51. The apparatus of claim 50, further comprising a number-of-bits adjusting portion comparing the number of bits allocated for the entire digital input signal by the bit allocation portion with the number of bits required for the entire digital input signal and adjusting the number of bits allocated for the entire digital input signal according to a result of the comparison.

52. The apparatus of claim 50, wherein the linear quantization portion comprises:

a data normalization portion normalizing the samples obtained by the data transformation portion using a predetermined scale factor;

a section quantization portion dividing a range of normalized sample values into a predetermined number of sections and applying a linear function set for each section to the normalized sample values;

a scaling portion scaling the values obtained by the section quantization portion using the number of bits allocated for each quantization unit by the bit allocation portion; and a rounding portion rounding the scaled values to a nearest whole number using the number of allocated bits to obtain quantized values.

53. A method of decoding a digital signal, comprising:

extracting data that is linearly quantized by sections and side information from a bitstream, the side information including a number of bits to be allocated for each quantization unit;

dequantizing the linearly quantized data by sections corresponding to the sections divided for the linear quantization, using the side information; and producing a digital signal from the dequantized data using an inverse transformation of a transformation used for encoding.

54. The method of claim 53, wherein the side information further includes at least a scale factor of each quantization unit.

55. The method of claim 53, wherein the dequantizing of the linearly quantized data by sections comprises:

performing an inverse scaling of a scaling used for quantization on the data which is linearly quantized by sections, by using bit allocation information;

linearly dequantizing the inversely scaled data by the sections; and denormalizing the dequantized data using an inverse scale factor corresponding to a scale factor used for quantization.

56. The method of claim 53, wherein the inverse transformation of the dequantized digital signal is performed using one of an inverse modified discrete cosine transform, an inverse fast Fourier transform, an inverse discrete cosine transform, and a sub-band synthesis filtering.

57. A method of decoding a digital signal, comprising:

extracting quantized data, side information, and frame length information from a bitstream comprised of frames, the side information including a number of bits to be allocated for each quantization unit;

dequantizing the quantized data using the side information; and producing a digital signal from the dequantized data using an inverse transformation of a transformation used for encoding.

58. A method of decoding a digital signal, comprising:

extracting data that is linearly quantized by sections, side information, and frame length information from a bitstream comprised of frames, the side information including a number of bits to be allocated for each quantization unit;

dequantizing the linearly quantized data by sections corresponding to sections divided for quantization, using the side information; and producing a digital signal from the dequantized data using an inverse transformation of a transformation used for encoding.

59. The method of claim 58, wherein the side information further includes at least a scale factor of each quantization unit.

60. The method of claim 58, wherein in the extracting of the linearly quantized data, the side information, and the frame length information, sync information is further extracted from the bitstream comprised of frames.

61. The method of claim 58, wherein the dequantizing of the linearly quantized data by sections comprises:

performing an inverse scaling of a scaling used for quantization on the data which is linearly quantized by sections, by using bit allocation information;

linearly dequantizing the inversely scaled data by the sections; and denormalizing the dequantized data using an inverse scale factor corresponding to a scale factor used for quantization.

62. The method of claim 58, wherein the inverse transformation of the dequantized digital signal is performed using one of an inverse modified discrete cosine transform, an inverse fast Fourier transform, an inverse discrete cosine transform, and a sub-band synthesis filtering.

63. An apparatus for decoding a digital signal, comprising:

a bit unpacking portion extracting linearly quantized data and side information from a bitstream, the side information including a number of bits to be allocated for each quantization unit;

a linear dequantization portion dequantizing the linearly quantized data by sections corresponding to sections divided for the linear quantization, using the side information; and an inverse transformation portion producing a digital signal from the dequantized data using an inverse transformation of a transformation used for encoding.

64. The apparatus of claim 63, wherein the side information further includes at least a scale factor of each quantization unit.

65. The apparatus of claim 64, wherein the bitstream analyzing portion further extracts sync information from the bitstream comprised of frames.

66. The apparatus of claim 63, wherein the linear dequantization portion comprises:

an inverse scaling portion performing an inverse scaling of a scaling used for quantization on the data which is linearly quantized by sections, by using bit allocation information included in the side information of the bitstream analyzing portion;

a section linear dequantization portion linearly dequantizing the inversely scaled data by the sections; and a denormalizing portion denormalizing the dequantized data using an inverse scale factor corresponding to a scale factor used for quantization.

67. An apparatus for decoding a digital signal, comprising:

a bitstream analyzing portion extracting quantized data, side information, and frame length information from a bitstream comprised of frames, the side information including a number of bits to be allocated for each quantization unit;

a dequantization portion dequantizing the quantized data using the side information; and an inverse transformation portion producing a digital signal from the dequantized data using an inverse transformation of a transformation used for encoding.

68. An apparatus for decoding a digital signal, comprising:

a bitstream analyzing portion extracting data that is linearly quantized by sections, side information, and frame length information from a bitstream comprised of frames, the side information including a number of bits to be allocated for each quantization unit;

a linear dequantization portion dequantizing the linearly quantized data by sections corresponding to sections divided for quantization, using the side information; and an inverse transformation portion producing a digital signal from the dequantized data using an inverse transformation of a transformation used for encoding.

69. The apparatus of claim 68, wherein the side information further includes at least a scale factor of each quantization unit.

70. The apparatus of claim 68, wherein the bitstream analyzing portion further extracts sync information from the bitstream comprised of frames.

71. The apparatus of claim 68, wherein the linear dequantization portion comprises:

an inverse scaling portion performing an inverse scaling of a scaling used for quantization on the data which is linearly quantized by sections, by using bit allocation information included in the side information of the bitstream analyzing portion;

a section linear dequantization portion linearly dequantizing the inversely scaled data by the sections; and a denormalizing portion denormalizing the dequantized data using an inverse scale factor corresponding to a scale factor used for quantization.

72. A computer-readable storage medium storing instructions to cause a computer to execute a method of encoding a digital signal, the method comprising:

transforming a digital input signal into samples to remove redundant information among signals;

selecting a lookup table corresponding to a characteristic of the digital input signal among a plurality of lookup tables that indicate different numbers of bits allocated for each of a plurality of quantization units depending on different characteristics of input signals and acquiring the number of bits allocated for each quantization unit from the selected lookup table;

dividing a distribution of samples within each quantization unit into a predetermined number of sections and linearly quantizing the samples using the allocated number of bits on a section-by-section basis; and producing a bitstream from the linearly quantized samples and predetermined side information, wherein the characteristic of the digital input signal in the selecting of the lookup table and acquiring of the number of bits allocated comprises the number of frequency bands including samples at occupancy rates no less than or no greater than a predetermined reference value among frequency bands of the digital input signal.

73. A computer-readable storage medium storing instructions to cause a computer to execute a method of decoding a digital signal, the method comprising:

extracting data that is linearly quantized by sections, side information, and frame length information from a bitstream comprised of frames the side information including a number of bits to be allocated for each quantization unit;

dequantizing the linearly quantized data by sections corresponding to sections divided for quantization, using the side information; and producing a digital signal from the dequantized data using an inverse transformation of a transformation used for encoding.

* * * * *

UNITED STATES PATENT AND TRADEMARK OFFICE

CERTIFICATE OF CORRECTION

PATENT NO. : 7,752,041 B2
APPLICATION NO. : 11/137427
DATED : July 6, 2010
INVENTOR(S) : Dohyung Kim et al.

It is certified that error appears in the above-identified patent and that said Letters Patent is hereby corrected as shown below:

Column 29, Line 27 after "section" insert -- ; --.

Column 35, Line 6 delete "frames" and insert -- frames, --, therefor.

Signed and Sealed this

Second Day of November, 2010

David J. Kappos

David J. Kappos
*Director of the United States Patent and Trademark Office*